US011840678B2

(12) United States Patent
Notari et al.

(10) Patent No.: US 11,840,678 B2
(45) **Date of Patent: *Dec. 12, 2023**

(54) MIXTURE CONTAINING CALIXARENES, PROCESS FOR THE PRODUCTION THEREOF AND USE THEREOF FOR PREPARING DETERGENT COMPOSITIONS FOR LUBRICANTS

(71) Applicant: ENI S.P.A., Rome (IT)

(72) Inventors: Marcello Notari, San Donato Milanese (IT); Giulio Assanelli, San Donato Milanese (IT); Alessandro Casnati, Parma (IT); Francesco Sansone, Parma (IT); Andrea Magini, Camerino (IT)

(73) Assignee: ENI S.P.A., Rome (IT)

( * ) Notice: Subject to any disclaimer, the term of this patent is extended or adjusted under 35 U.S.C. 154(b) by 0 days.

This patent is subject to a terminal disclaimer.

(21) Appl. No.: 17/619,954

(22) PCT Filed: Jun. 26, 2020

(86) PCT No.: PCT/IB2020/056083

§ 371 (c)(1),
(2) Date: Dec. 16, 2021

(87) PCT Pub. No.: WO2020/261217

PCT Pub. Date: Dec. 30, 2020

(65) Prior Publication Data

US 2022/0298445 A1 Sep. 22, 2022

(30) Foreign Application Priority Data

Jun. 26, 2019 (IT) ..... 102019000010092

(51) Int. Cl.
*C10M 159/22* (2006.01)
*C10N 30/00* (2006.01)
(Continued)

(52) U.S. Cl.
CPC .... *C10M 159/22* (2013.01); *C10M 2207/028* (2013.01); *C10N 2030/02* (2013.01);
(Continued)

(58) Field of Classification Search
CPC ..... C10M 159/22; C10M 2207/028; C10M 2209/101; C10N 2030/02; C10N 2030/04;
(Continued)

(56) References Cited

U.S. PATENT DOCUMENTS 5,114,601 A 5/1992 Cook et al.
5,602,084 A 2/1997 Moreton
(Continued)

OTHER PUBLICATIONS

International Search Report dated Sep. 23, 2020 for PCT Appl. No. PCT/IB2020/056083.
(Continued)

*Primary Examiner* — Ellen M McAvoy
(74) *Attorney, Agent, or Firm* — Ruggiero McAllister & McMahon LLC

(57) ABSTRACT

There are mixtures containing calixarenes of formula (I) with a reduced alkyl phenol and linear oligomer content and a preparation process thereof:

I (Continued)

wherein:

a. R is selected between a linear or branched alkyl having a number of carbon atoms comprised between 4 and 40, more preferably between 4 and 24, even more preferably comprised between 8 and 18;

b. n is the number of units of the calixarene cycle and is comprised in the range from 4 to 16, preferably between 4 and 12.

Furthermore, there are detergent compositions containing overbased metal salts of calixarenes, a preparation process thereof, and a use thereof in lubricant compositions.

39 Claims, 1 Drawing Sheet

(51) Int. Cl.
*C10N 30/02* (2006.01)
*C10N 30/04* (2006.01)
*C10N 40/25* (2006.01)

(52) U.S. Cl.
CPC ..... *C10N 2030/04* (2013.01); *C10N 2030/52* (2020.05); *C10N 2040/25* (2013.01)

(58) Field of Classification Search
CPC ..... C10N 2030/52; C10N 2040/25; C10N 2010/04; C10N 2020/02
See application file for complete search history.

(56) References Cited

U.S. PATENT DOCUMENTS

| | | | | |
|---|---|---|---|---|
| 5,780,403 | A * | 7/1998 | Moreton | C07C 43/21 568/640 |
| 6,174,844 | B1 * | 1/2001 | Moreton | C10M 159/22 508/585 |
| 6,200,936 | B1 | 3/2001 | Moreton | |
| 6,268,320 | B1 * | 7/2001 | Crawford | C10M 159/22 508/572 |
| 10,584,299 | B2 * | 3/2020 | Notari | C10M 159/005 |
| 10,807,939 | B2 * | 10/2020 | Notari | C10M 159/22 |
| 11,078,437 | B2 * | 8/2021 | Notari | C10M 155/02 |
| 2017/0051224 | A1 * | 2/2017 | Notari | C10M 119/02 |
| 2018/0237375 | A1 | 8/2018 | Notari et al. | |
| 2018/0355273 | A1 * | 12/2018 | McKenzie | C10M 169/04 |

OTHER PUBLICATIONS

Written Opinion Report dated Sep. 23, 2020 for PCT Appl. No. PCT/IB2020/056083.

* cited by examiner

MIXTURE CONTAINING CALIXARENES, PROCESS FOR THE PRODUCTION THEREOF AND USE THEREOF FOR PREPARING DETERGENT COMPOSITIONS FOR LUBRICANTS

CROSS-REFERENCE TO RELATED APPLICATIONS

This Patent Application claims priority from PCT Application No. PCT/IB2020/056083, filed Jun. 26, 2020, which claims priority from Italian Patent Application No. 102019000010092 filed on Jun. 26, 2019, the entire disclosures of both of which are incorporated herein by reference.

FIELD OF THE DISCLOSURE

The present disclosure relates to the field of manufacturing detergents free from sulphur or with a low sulphur content for lubricants.

The present disclosure relates to mixtures containing calixarenes with a reduced content of alkylphenols and linear oligomers, and to a process for the preparation thereof. Furthermore, the present disclosure relates to detergent compositions for lubricants containing overbased metal salts of calixarenes and the preparation process thereof.

DESCRIPTION OF THE RELATED ART

Calixarenes are well-known cyclic compounds, deriving from the condensation of substituted para phenols and formaldehyde. Conventionally, the size of the macrocycle of calixarenes is identified in their nomenclature by indicating such products as calix[n]arenes, wherein n denotes the number of aromatic units present in the cyclic product. Calixarenes can be applied in different sectors such as in the complexation and removal of small molecules and metal cations such as for example cations of radioactive metals; in the biomedical field such as for example in the recognition of nucleic acids and proteins, in sensors and in the field of additives, for example as antioxidants and in particular as raw materials for the preparation of detergents for lubricants.

The synthesis of calixarenes having formula (1n), shown in the following diagram 1, is known in the state of the art and is typically performed through the condensation between phenols of formula (1), preferentially para-alkyl substitutes (e.g. R'=tert-$C_4H_9$, tert-$C_8H_{17}$) and formaldehyde at high temperature.

Diagram 1

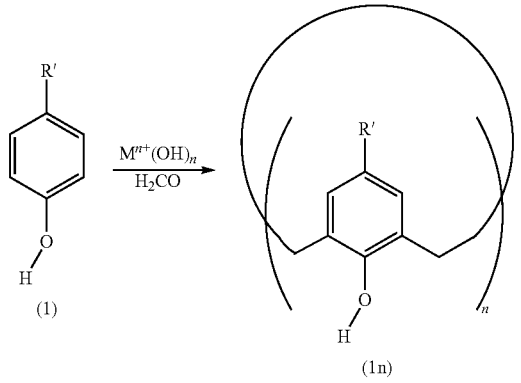

As highlighted in diagram 1, the catalysts usually used are metal hydroxides, preferably alkali or alkaline-earth metals, as reported, for example, in "Gutsche, C. D. et al. Org. Synth. 1990, 68, 234-246".

Typically, the dimension of the macrocycle can be appropriately modulated by changing the base cation, the solvent and the heating temperature. In the case of some phenols, typically para-tert-butylphenol, consolidated experimental procedures reported, for example, in "Gutsche, C. D. et al. Org. Synth. 1990, 68, 234-246 e Gutsche, C. D. Org. Prep. Proced. Int. 1992, 25, 137-139") enable the synthesis to be directed with excellent yields (60-90%) on calixarenes of formula (1n) with $R_2$=tert-$C_4H_9$ and bearing n=4, 5, 6 or 8. In all these cases the final products derive from a purification, by crystallization, typically with methanol or toluene, which enables the desired calixarene to be separated from the other calixarenes, from unreacted p-tert-butylphenol and from linear oligomers.

In the state of the art the preparation of calixarenes having formula (1n) with R'=tert-$C_8H_{17}$ (p-tert-octyl calix[n]arenes) is also known. As reported in literature (Bocchi V. et al. Tetrahedron 1982, 38, 3, 373-378; Cornforth J. W. et al. J. Pharmacol. 1955, 10, 73), their synthesis is performed by reacting p-tert-octylphenol in xylene solution with 37% formaldehyde and NaOH in an inert atmosphere at 120° C. After removal of water in the first two hours, it is heated under reflux for further 4 hours. Subsequently, about 75% of the xylene is removed and then 2-propanol is added, which leads to the precipitation of cyclic products only, corresponding to p-tert-octyl calix[6]- and -[8]arenes, with a 50% yield, which can thus be isolated from unreacted p-tert-octylphenol and from the linear oligomers that remain in the re-crystallization solutions.

The aforementioned calixarenes deriving from para-tert-butylphenol are not suitable for the preparation of detergent compositions for lubricants as the corresponding metal salts are not very soluble in lubricant base oil. Metal salts of calixarenes deriving from para-tert-octylphenol instead have good solubility in lubricant base oils but the corresponding calixarenes are obtained with a low yield due to the incomplete conversion of para-tert-octylphenol and linear oligomers in calixarenes.

WO 2017/025900 describes metal compounds of calixarenes that do not contain sulphur and are dispersible in oil, and that can be partially salified, neutral, basic and overbased. The patent application further describes detergent compositions comprising said metal compounds of calixarenes and use in lubricant formulations as detergent additives able to consistently reduce the formation of deposits and the preparation process thereof.

The calixarenes described have general formula (Y):

(Y)

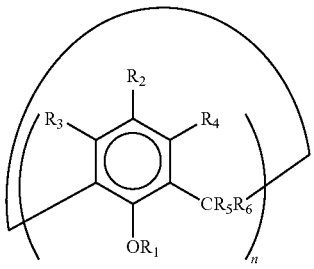

wherein:

a. $R_1$, $R_2$, $R_3$ and $R_4$ are selected independently from hydrogen, or a group containing carbon and hydrogen, or a group containing in addition to carbon and hydrogen also heteroatoms provided that said heteroatoms are not sulphur;

b. one of the two substituents $R_5$ and $R_6$ is hydrogen, while the other can be selected from hydrogen or a linear or branched alkyl with a number of carbon atoms comprised between 1 and 6, preferably methyl, ethyl, 1-propyl, 2-propyl, n-butyl, sec-butyl, more preferably methyl or ethyl;

c. n is the number of units of the calixarene cycle and is comprised in the range from 4 to 16, preferably between 5 and 12.

The calixarenes described must have in at least one of the n units of the calixarene cycle and in at least one of the substituents $R_1$, $R_2$, $R_3$ and $R_4$, at least one acid group of the carboxylic type available for the reaction with a metal base, with the condition that said acid group of the carboxylic type is not contained in a unit of the calixarene cycle deriving from salicylic acid. In particular, the calixarenes described derive from the condensation reaction of p-alkyl-phenols with formaldehyde, wherein one of the preferred p-alkyphenols is branched para-dodecyl phenol (4-tetrapropenylphenol), which is constituted by a mixture of phenols mainly para-substituted with branched alkyl groups and corresponding to molecular formulae comprised between $C_{11}H_{23}$ and $C_{14}H_{29}$. The calixarenes that are obtained have excellent solubility in lubricant base oil. From such reaction a mixture of products is obtained containing 60% wt/wt of cyclic compounds (calixarenes). The remaining 40% wt/wt is comprised of unreacted 4-tetrapropenylphenol (TPP) and a mixture of linear oligomers. Therefore, the yield of cyclic calixarene compounds is low and in this case it is not easy to separate the cyclic products from the linear ones by precipitation. The presence of high quantities of alkylphenols in calixarenes, and in particular of TPP, represents a problem as since 1 Mar. 2018 TPP has been considered by the European Community, according to the Globally Harmonized System of Classification GHS, reproductive toxicant category 1B. On the basis of such classification, substances or mixtures, and therefore also detergent compositions derived from calixarenes, having a TPP content >0.3% wt/wt, must be classified as reproductive toxicants.

In relation to the detergent compositions of patent application WO 2017/025900, the presence of unreacted TPP in calixarene does not represent the problem as the preparation of the detergent is performed after the functionalization reaction, wherein also the TPP is transformed into the corresponding carboxylic methylene acid derivative.

Although the latter detergent compositions have excellent characteristics and performance levels they are expensive as their production process comprises three reaction stages (synthesis of calixarene, functionalization of calixarene and preparation of the detergent). The detergent compositions obtained with two reaction stages (synthesis of calixarene and subsequent preparation of the detergent) are much cheaper, such as those described in patents EP 450874 and EP 755998, but have the problem of containing too high concentrations of free alkylphenol, in particular of TPP and its corresponding calcium salt, which are toxic. Furthermore, such detergent compositions, in most cases, derive from mixtures containing together with calixarenes also high concentrations of linear oligomers, which make it more difficult to obtain overbased detergents with high alkalinity and therefore able to effectively neutralize the acidity that is formed in the engine lubricant during the use thereof.

Patent EP 450874 describes a class of overbased metal salts of calixarenes not containing sulphur having as substituents the hydroxyl group or groups able to react with a metal base. In patent EP 450874 the overbased metal salts described are salts of alkaline earth metals, such as calcium, magnesium and barium, of a calix[n]arene having formula (Z):

(Z)

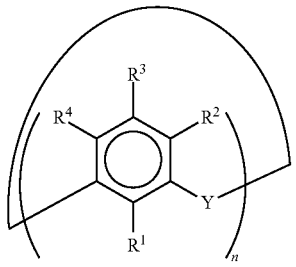

wherein Y is a divalent bridge group; $R^3$ is a group containing carbon and hydrogen or a group containing heteroatoms as well as carbon and hydrogen; n is an integer comprised between 3 and 9, and alternatively $R^1$ is hydroxyl and $R^2$ and $R^4$ are independently hydrogen, or a group containing carbon and hydrogen, or a group containing heteroatoms as well as carbon and hydrogen, or $R^2$ and $R^4$ are hydroxyl and $R^1$ is independently hydrogen, or a group containing carbon and hydrogen, or a group containing heteroatoms as well as carbon and hydrogen.

Patent EP 450874 further describes a process for the production of such overbased metal salts, which comprises the reaction of a metal base, preferably calcium hydroxide and/or calcium oxide, with a calixarene having formula (Z), or with a metal salt of calixarene having formula (Z), wherein the quantity of metal is less than the stoichiometric quantity of acid; or with the neutral or overbased metal salt of the calixarene of formula (Z).

The metal base can be fed to the reaction mixture with a single addition or multiple additions at different times during the reaction. Subsequently to each addition of the metal base, carbon dioxide is added which transforms the calcium hydroxide into calcium carbonate. The process is performed in the presence of solvents.

In response to the need to have the availability of overbased salts of calixarenes with a higher alkalinity value, patent EP 755998 describes overbased salts of calixarenes which, unlike those described in patent EP 450874, have a molecular weight of at least 1880 Da, obtained with alkyl substituents with a longer chain.

Also these products, like those of patent EP 450874, have a non-optimal alkalinity value determined by an insufficiently high content of cyclic products, which makes the capacity to effectively neutralize the acidity that is formed in the lubricant non-optimal.

Therefore, it is fundamental to have the availability of a process for manufacturing calixarenes which enables cyclic products to be obtained with a high yield and low unreacted alkylphenol and linear oligomer content, which does not require long and expensive purification steps and that is therefore cheap and easy to industrialize. It is also fundamental to have available a process that is easy to industrialize for preparing detergent compositions containing overbased metal salts of said calixarenes and that enables products to be obtained with high alkalinity and low toxic impurity content, such as alkylphenol and its corresponding metal salt.

The Applicant has therefore found a process for the preparation of mixtures containing calixarenes, linear oligomers in a quantity less than or equal to 20% and unreacted alkylphenol in a quantity less than or equal to 2.0%, the percentages expressed as a percentage by weight of the total mixture.

The Applicant has therefore further found a process for the production of detergent compositions for lubricants containing overbased metal salts of calixarenes starting from a mixture that contains calixarenes, linear oligomers in a quantity less than or equal to 20% and unreacted alkylphenol in a quantity less than or equal to 2.0%, the percentages expressed as a percentage by weight of the total mixture.

The process for preparing the mixtures containing calixarenes described and claimed enables high yields of cyclic products to be reached, minimizing the unreacted alkylphenol content and the content of linear oligomers.

The calixarene thus produced is used for preparing detergent compositions for lubricants by means of an improved process, which produces detergent compositions containing the overbased metal salt of said calixarenes, characterized by a low content of unreacted alkylphenol and its corresponding metal salt, and characterized by high alkalinity and low viscosity and turbidity values.

In the present patent application, "overbased metal salts" are those salts which contain an excess of metal with respect to the acid part, mainly in the form of metal carbonate, but also metal hydroxide.

The detergent compositions containing overbased metal salts generally have alkalinity able to neutralize the acidity that is formed during the use of the lubricant. The alkalinity of a detergent is determined by means of the ASTM D2896 method, which enables the value of the Total Base Number (TBN) to be measured, expressed in mg KOH/g.

The detergent compositions containing overbased metal salts of calixarenes, according to the present patent application, as well as having excellent detergent properties, i.e. a high capacity to reduce the formation of deposits on the metallic surfaces of the engine, are characterized by a high alkalinity value able to guarantee the effective neutralization of the acidity that is formed in a lubricant during the use thereof.

SUMMARY OF THE DISCLOSURE

In the present patent application, all the operating conditions reported in the text must be understood as preferred conditions even if not expressly declared.

For the purposes of the present discussion the term "to comprise" or "to include" also comprises the term "to consist in" or "essentially consisting of".

For the purposes of the present discussion the definitions of the intervals always comprise the extreme values unless otherwise specified.

Therefore, the subject matter of the present patent application is a mixture of compounds that comprises:

calixarenes not containing sulphur and soluble in lubricant base oil, having the following general formula:

(I)

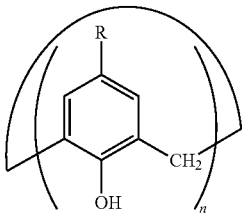

wherein:

a. R is selected between a linear or branched alkyl having a number of carbon atoms comprised between 4 and 40, more preferably between 4 and 24, even more preferably comprised between 8 and 18;

b. n is the number of units of the calixarene cycle and is comprised in the range between 4 and 16, preferably between 4 and 12;

a concentration of unreacted alkylphenol, expressed as a percentage by weight of the alkylphenol on the mixture, less than or equal to 2.0%, more preferably less than or equal to 1.0%, even more preferably less than or equal to 0.5%; said alkylphenol having the general formula:

(II)

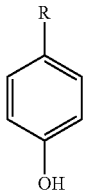

wherein R assumes the meaning already described for formula (I).

a concentration of linear oligomers, expressed as a percentage by total weight of linear oligomers on the total mixture, less than or equal to 20%, more preferably less than or equal to 15%, even more preferably less than or equal to 5%; said linear oligomers having the general formula (III)

(III)

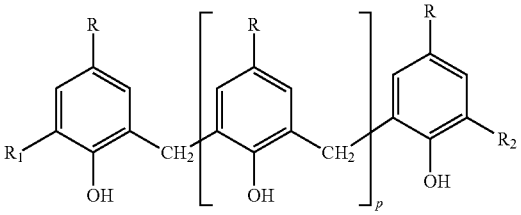

wherein R assumes the meaning already described for the formula (I), $R_1$ and $R_2$ may be hydrogen, or the hydroxymethylene group (—$CH_2OH$) and p is comprised between 0 and 6, preferably between 0 and 4.

Further subject matter of the present patent application is a process for preparing said mixtures of compounds, which contain calixarenes with a low unreacted alkylphenol and linear oligomer content (also defined as impurities in the present patent application); said process comprising the following steps, which can preferably also be performed consecutively in the same reactor:

Performing a condensation reaction between alkylphenol and formaldehyde in aqueous solution at a certain temperature comprised between 70° C. and 125° C., at a pressure that ranges from 1 bar to 5 bar, and for a reaction time that ranges from 1 hour to 5 hours; for forming a first intermediate product (INTERMEDIATE 1), in the presence of a basic catalyst, in the absence of solvent and without removal of the water present in the aqueous solution of formaldehyde and which is formed during the condensation reaction; subsequently distilling said first intermediate product (INTERMEDIATE 1), increasing the temperature up to a maximum of 130° C. inclusive and partially removing the water deriving from the aqueous formaldehyde solution and from the condensation reaction, to form a second intermediate product (INTERMEDIATE 2); subsequently adding to the second intermediate product a solvent, preferably a portion of the solvent and completing the condensation reaction without further removal of the water, forming a third intermediate product (INTERMEDIATE 3), which contains linear oligomers having formula (III), wherein R is as described for formula (I), $R_1$ and $R_2$ are hydrogen, or the hydroxymethylene group (—$CH_2OH$), and p is comprised between 0 and 6, preferably between 0 and 4;

then adding the remaining portion of the solvent to said third intermediate product (INTERMEDIATE 3) and completely removing the water present in the third intermediate product by distillation, forming by cyclization of the linear oligomers a final mixture that contains the mixture of compounds, sediments and solvent; subsequently separating said sediments, preferably by filtration or extraction with demineralized water, from said mixture; subsequently distilling said mixture removing the residual water and partially or totally the reaction solvent.

Said process has the advantage of forming calixarenes in high yields and with a low content of unreacted alkylphenol and linear oligomers. Thanks to a reduced unreacted alkylphenol content, these calixarenes enable detergent compositions with low toxicity to be obtained, having a low content of alkylphenol and of its corresponding metal salt.

Further subject matter of the present disclosure is therefore a detergent composition comprising the overbased metal salts of calixarenes having general formula (I); said detergent compositions being characterized by:

a content of overbased metal salts of calixarenes of formula (I), expressed as a percentage by weight with respect to the detergent composition, comprised between 10% and 90%, preferably between 15% and 75%;

an alkylphenol content of formula (II) and its corresponding metal salt, expressed as the sum of the weight percentages of the alkylphenol and its metal salt with respect to the weight of the detergent composition, less than or equal to 0.29%, preferably less than or equal to 0.2%;

a content of overbased metal salts of linear oligomers of formula (III), expressed as a percentage by weight with respect to the weight of the detergent composition, less than or equal to 15%, preferably less than or equal to 5%;

a Total Base Number (TBN) value, expressed in mg KOH/g, between 120 and 550, preferably between 140 and 500;

a kinematic viscosity value at 100° C. less than or equal to 600 $mm^2/s$, preferably less than or equal to 500 $mm^2/s$.

Further subject matter of the present disclosure is the formulations or lubricant compositions, which contain the detergent compositions described and claimed, allowing optimal control of the formation of deposits and the effective neutralization of the inorganic and organic acidity, which is generated in the lubricant, thus enabling the control of wear and corrosion phenomena.

Further subject matter of the present patent application is a process for preparing detergent compositions comprising overbased metal salts of calixarenes of general formula (I); said process comprises the following steps:

preparing a mixture of compounds for detergent compositions according to the process described and claimed;

reacting said mixture of compounds through a salification reaction with an excess of metal base forming a first intermediate mixture (INTERMEDIATE MIX 1), and then adding water to the first intermediate mixture forming a second intermediate mixture (INTERMEDIATE MIX 2) and then, reacting said second intermediate mixture with carbon dioxide, according to a carbonation reaction which converts the unreacted metal base into metal carbonate, forming the detergent composition.

The process for preparing detergent compositions described and claimed in the present patent application enables products to be obtained with a content of alkylphenol and of its corresponding metal salt, expressed as a sum of the percentages by weight of the alkylphenol and of its metal salt with respect to the weight of the detergent composition, less than or equal to 0.29%, preferably less than or equal to 0.2%.

Said process further enables detergent compositions to be obtained with a content of overbased metal salts of linear oligomers of formula (III), expressed as a percentage by weight with respect to the weight of the detergent composition, less than or equal to 15%, preferably less than or equal to 5%.

Said process further enables detergent compositions to be obtained with high alkalinity, with a Total Base Number (TBN) value, expressed in mg KOH/g, comprised between 120 and 550, preferably comprised between 140 and 500. Said process further allows the kinematic viscosity value at 100° C. of the detergent composition to be controlled, maintaining the value of such parameter below 600 $mm^2/s$, preferably below 500 $mm^2/s$. All these characteristics make the detergent compositions industrially feasible.

Said detergents can be used for preparing automotive lubricants highly compatible with exhaust gas post-treatment devices of motor vehicle, for the reduction of pollutant emissions.

Said detergents can also be used for preparing lubricants for marine engines with high engine performances and lubricants for industrial applications, such as oils for gears with high energy efficiency.

BRIEF DESCRIPTION OF THE DRAWINGS

Further aims and advantages of the present disclosure will appear more clearly from the following description and from the accompanying figures, given purely by way of a non-limiting example, which represent preferred embodiments of the present disclosure.

With reference to examples 1 and 2.

With reference to examples 1 and 2.

DETAILED DESCRIPTION OF THE DISCLOSURE

Figure 1:
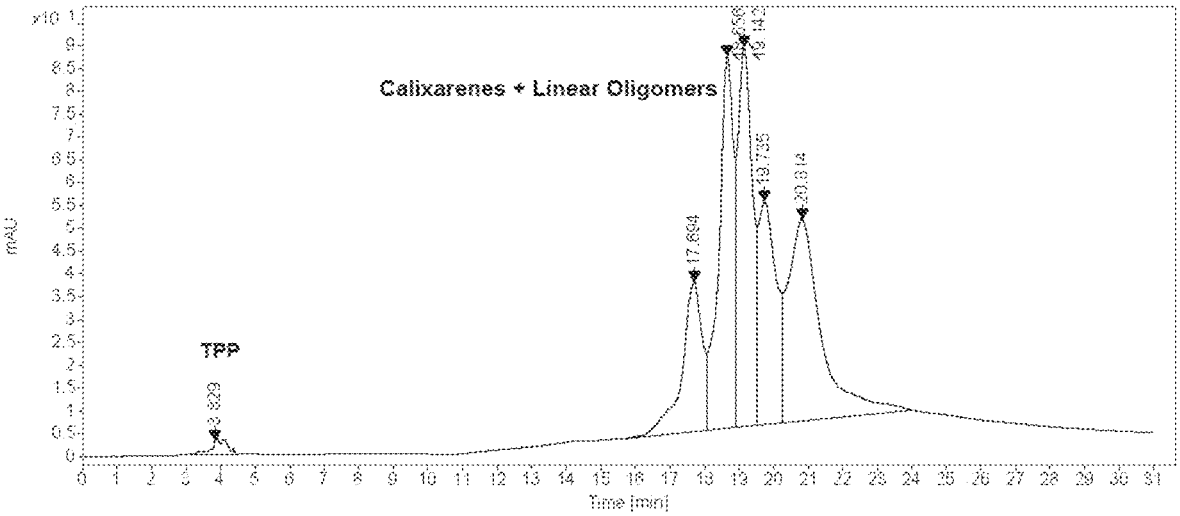
FIG. 1 illustrates the chromatogram related to the HPLC analysis for the determination of the tetra-propenylphenol (TPP) content in calixarene, expressed as a percentage by weight.

The Applicant now describes in detail the main and preferred embodiments of the present disclosure.

An embodiment according to the present patent application is a mixture of compounds that can be used for preparing detergent compositions and that comprises calixarenes having general formula (I), unreacted alkylphenol in a concentration less than or equal to 2.0%, expressed as a percentage by weight of alkylphenol on the mixture; linear oligomers in a concentration less than or equal to 20%, expressed as a percentage by weight of linear oligomers of the mixture.

The mixtures described and claimed in the present patent application can be used for preparing detergent compositions for different purposes and uses.

Said detergent compositions, free from sulphur or with a low sulphur content, can be used for preparing lubricants for the automotive industry that are highly compatible with devices for the post-treatment of exhaust gases of motor vehicles, for reducing the emissions of pollutants.

Said detergent compositions can also be used for preparing lubricants for marine engines with high engine performances and lubricants for industrial applications, such as oils for gears with high energy efficiency.

A further embodiment according to the present patent application is the process for preparing mixtures of compounds for the detergent compositions described and claimed.

Said process envisages a condensation reaction between alkylphenol and formaldehyde in aqueous solution for forming a first intermediate product (INTERMEDIATE 1).

The condensation reaction between alkylphenol and an aqueous solution of formaldehyde is performed at a temperature comprised between 70° C. and 125° C., preferably it may be performed between 80° C. and 110° C. The reaction time for the condensation reaction is comprised between 1 hour and 5 hours, preferably it may be comprised between 2 hours and 4 hours.

The absolute pressure at which the condensation reaction is performed is comprised between 1 bar and 5 bar absolute, preferably it may be comprised between 1 bar and 2 bar absolute.

Formaldehyde can be used in an amount, expressed as the ratio between formaldehyde equivalents and alkylphenol equivalents, preferably comprised between 1 and 2, more preferably comprised between 1.1 and 1.4, more preferably comprised between 1.25 and 1.35.

Formaldehyde is used as an aqueous solution, preferably stabilized with methanol, characterized by a concentration, expressed as a percentage by weight of formaldehyde with respect to the total weight of the solution, preferably comprised between 25% and 40%, more preferably between 30% and 40%, more preferably between 34% and 38%.

The condensation reaction between alkylphenol and an aqueous solution of formaldehyde is performed in the presence of a basic catalyst.

The basic catalyst may be a hydroxide of an alkali metal or an alkaline-earth metal, more preferably a hydroxide of an alkali metal selected from sodium hydroxide or potassium hydroxide. The quantity of basic catalyst used, expressed as an equivalent percentage of the metal hydroxide with respect to the alkylphenol equivalents, may preferably be comprised between 1% and 15%, more preferably comprised between 3% and 10%. Preferably the catalyst used is sodium hydroxide in aqueous solution at a concentration, expressed as a percentage by weight of NaOH with respect to the total weight of the solution, preferably comprised between 30% and 60%, more preferably comprised between 45% and 55%.

Preferred alkylphenols are those in which the alkyl substituent is present in the para position to the phenol hydroxyl. More preferably the alkylphenols that can be used in the production process of calixarenes, according to the present patent application, are selected from para-tert-octylphenol, para-alkylphenols whose alkyl group derives from polypropylene, polyisobutene and poly-1-butene, or mixtures thereof. The preferred para-alkylphenol is 4-tetrapropenylphenol, also indicated as branched para-dodecylphenol.

Once the first intermediate product is formed, it is distilled, increasing the temperature of the product to a maximum of 130° C. inclusive, preferably to a maximum of 115° C. inclusive. The distillation can be performed at an absolute pressure preferably comprised in the range between 0.5 bar and 1.5 bar, preferably in the range between 0.8 bar and 1.2 bar. The duration of this distillation step may be comprised between 0.5 hours and 4 hours, preferably between 1 hour and 3 hours.

The distillation partially removes the water present in the first intermediate product in a quantity, expressed as a percentage by weight with respect to the weight of the water present, preferably comprised between 20% and 99%, more preferably comprised between 50% and 90%, forming a second intermediate product (INTERMEDIATE 2).

To the second intermediate product, the solvent, preferably a part of the solvent, is added, with the purpose of reducing the viscosity of the mixture, continuing the condensation reaction, without the further removal of water, forming a third intermediate product (INTERMEDIATE 3).

The quantity of solvent added, expressed as a percentage by weight of said solvent with respect to the quantity of alkylphenol supplied, may preferably be comprised between 10% and 500%, more preferably comprised between 20% and 100%, even more preferably comprised between 25% and 40%.

The condensation reaction is thus continued, without the removal of water, keeping the second intermediate product at a temperature preferably comprised between 100° C. and 140° C., more preferably between 105° C. and 120° C. During the completion of the condensation reaction the pressure is preferably comprised between 1 bar and 5 bar, even more preferably between 1.1 and 3 bar. The completion of the condensation reaction has a duration preferably comprised between 0.5 hours and 5 hours, more preferably between 1 hour and 4 hours.

Suitable solvents are those that are not miscible in water and having a boiling point greater than or equal to the maximum desired temperature in the condensation reaction between para-alkylphenol and formaldehyde. Said solvents may preferably be selected from among aromatic hydrocarbons with a number of carbon atoms comprised between 6 and 16, more preferably selected between toluene, xylene and tetraline; aliphatic or cycloaliphatic hydrocarbons with a number of carbon atoms comprised between 7 and 16, more preferably decane or decaline; alkyl, aryl-alkyl and aromatic ethers with a number of carbon atoms comprised between 8 and 16, more preferably anisole and diphenyl ether.

At the end of the condensation reaction, the conversion of the alkylphenol obtained is greater than 98%, preferably greater than 99%, and an intermediate product is obtained which contains linear oligomers of formula (III):

(III)

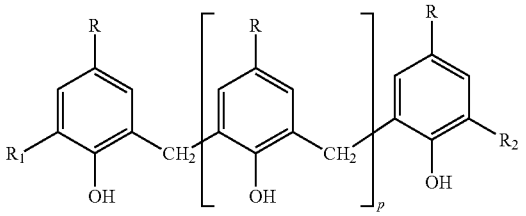

wherein R is as described for the formula (I), $R_1$ and $R_2$ are hydrogen, or the hydroxymethylene group (—$CH_2OH$) and p is comprised between 0 and 6, preferably between 0 and 4.

To the third intermediate product the remaining quantity of solvent is added and the water present is completely removed by distillation.

Then the linear oligomers are condensed forming a final mixture that contains the mixture of compounds for detergent compositions, solvent and sediments.

Said sediments are separated from said final mixture, preferably by filtration or extraction with demineralized water; subsequently the resulting mixture containing the mixture of compounds for detergent compositions and solvent is distilled, partially or totally removing any water and the solvent.

The solvent is then added to the third intermediate product preferably in a quantity, expressed as a percentage by weight of said solvent with respect to the quantity of alkylphenol subjected to the condensation reaction, comprised between 10% and 500%, preferably comprised between 200% and 400%, even more preferably comprised between 250% and 350%.

In this step, using for example a Dean Stark apparatus, all the water present in the third intermediate product is removed by distillation.

The distillation may preferably be performed at a temperature comprised between 110° C. and 180° C., more preferably between 130° C. and 150° C. and at an absolute pressure preferably comprised between 0.5 and 4 bar, more preferably comprised between 0.8 and 2 bar. The duration of the distillation may preferably be comprised between 0.5 hours and 4 hours, more preferably between 1 hour and 3 hours. At the end of the distillation the linear oligomers are converted by cyclization into the calixarenes of formula (I).

The removal of the sediments present in the final mixture can take place by separation, preferably by filtration or by extraction with water, more preferably by extraction in the aqueous phase. Aqueous extraction is preferable to filtration as the latter can be slow and can therefore cause a reduction of the process productivity.

The aqueous extraction of the sediments can be performed by adding to the final mixture, maintained at a temperature preferably comprised between 20° C. and 120° C., more preferably between 50° C. and 100° C., demineralized water in a quantity, expressed as a percentage by weight with respect to the quantity of alkylphenol subjected to the alkylation reaction, preferably comprised between 50% and 300%, more preferably between 100% and 200%. The mixture is kept stirred at said temperature for a time comprised preferably between 10 minutes and 1 hour, more preferably between 15 minutes and 45 minutes, then the stirring is interrupted and the mixture is left to rest for a time comprised between 10 minutes and 1 hour, more preferably between 15 minutes and 45 minutes.

The aqueous phase is unloaded from the bottom of the extraction container, which can preferably be the same reactor in which the condensation reaction was performed.

Then, the final separated mixture containing the calixarenes of formula (I) and impurities is heated, preferably to a temperature comprised between 100° C. and 200° C., and preferably using a Dean Stark apparatus, removing by distillation any water present in said mixture and then removing the solvent by distillation. The distillation of the water and of the solvent may preferably be performed at atmospheric pressure, or at reduced pressure. The solvent may preferably be partially or completely removed. In preferred embodiment, the solvent is partially removed in such a way to obtain a solution with a product concentration, expressed as a percentage by weight with respect to the solution constituted by product and solvent, comprised between 20% and 90%, preferably comprised between 40% and 60%.

The compounds thus formed contain:

calixarenes not containing sulphur, soluble in lubricant base oil, having the following general formula (I):

(I)

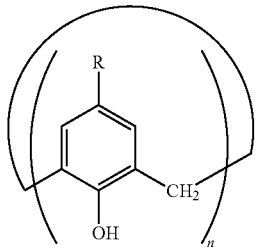

wherein:

R is selected from a linear or branched alkyl having a number of carbon atoms ranging from 4 to 40;

n is the number of units of the calixarene cycle and is comprised in the range between 4 and 16;

a concentration of unreacted alkylphenol, expressed as a percentage by weight of the alkylphenol on the mixture of compounds, less than or equal to 2.0%, more preferably less than or equal to 1.0%, even more preferably less than or equal to 0.5%, expressed as a percentage by weight of the alkylphenol on the mixture of compounds for detergent compositions, said alkylphenol having the general formula (II)

(II)

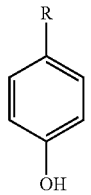

wherein R is as described for formula (I);

a concentration of linear oligomers, expressed as a percentage by weight of linear oligomers on the mixture of compounds, less than or equal to 20%; more preferably less than 15%, even more preferably less than 5%; expressed as a percentage by weight of linear oligomers on the mixture of compounds for detergent compositions; said linear oligomers having the general formula (III)

(III)

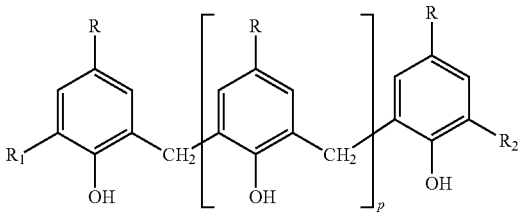

wherein R is as described for the formula (I), $R_1$ and $R_2$ are hydrogen, or the hydroxymethylene group (—$CH_2OH$) and p is comprised between 0 and 6, preferably between 0 and 4.

A further embodiment according to the present disclosure is a detergent composition comprising the overbased metal salts of calixarenes of general formula (I); said detergent compositions being characterized by:

a content of overbased metal salts of calixarenes of formula (I), expressed as a percentage by weight with respect to the detergent composition, comprised between 10% and 90%, preferably between 15% and 75%;

an alkylphenol content of formula (II) and its corresponding metal salt, expressed as the sum of the weight percentages of the alkylphenol and its metal salt with respect to the weight of the detergent composition, less than or equal to 0.29%, preferably less than or equal to 0.2%;

a content of overbased metal salts of linear oligomers of formula (III), expressed as a percentage by weight with respect to the weight of the detergent composition, less than or equal to 15%, preferably less than or equal to 5%;

a Total Base Number (TBN) value, expressed in mg KOH/g, between 120 and 550, preferably between 140 and 500;

a kinematic viscosity value at 100° C. less than or equal to 600 $mm^2/s$, preferably less than or equal to 500 $mm^2/s$.

The metal of the overbased metal salts of the mixture of compounds for detergents described and claimed in the present patent application, which comprises calixarenes having general formula (I), is selected from alkali metals, alkaline-earth metals and any other metal, the basic compounds of which are able to form salts with said mixture of compounds. For the purposes of the present disclosure, the alkali metals that can be used are selected from Li, Na, K, Rb e Cs; the alkaline-earth metals that can be used are selected from Be, Mg, Ca, Sr and Ba. The preferred metals are alkaline-earth metals, particularly preferred are magnesium and calcium, even more preferred is calcium.

The metal content of the overbased metal salts of said mixture of compounds for detergents corresponds to a ratio between the metal and acid equivalents comprised between 0.15 and 15, preferably comprised between 0.5 and 10, even more preferably between 0.9 and 8.

In the overbased metal salts of the mixture of compounds for detergents, which comprises calixarenes having general formula (I), the excess of metal with respect to the organic acid is in the form of metal carbonate and metal hydroxide.

The overbased metal salt of the calixarene of formula (I) comprises the neutral metal salt of the calixarene of formula (I) at a concentration, expressed as a percentage by weight with respect to said overbased metal salt of calixarene, comprised between 10% and 90%, more preferably between 20% and 80%.

The overbased metal salt of the calixarene of formula (I) also comprises the metal carbonate at a concentration, expressed as a percentage by weight with respect to said overbased metal salt of calixarene comprised between 5% and 80%, more preferably between 10% and 60%.

The overbased metal salt of the calixarene of formula (I) can also comprise calcium hydroxide at a concentration, expressed as a percentage by weight with respect to said overbased metal salt of calixarene, comprised between 0.5% and 15%, more preferably between 2% and 8%.

In a preferred embodiment the detergent compositions can comprise one or more lubricant base oils at a concentration, expressed as a percentage of the base oil with respect to the detergent composition, comprised between 10% and 90%, preferably between 20% and 70%.

The base oils used in the present disclosure can be selected from base oils of mineral, synthetic, vegetable or animal origin and mixtures thereof. Oils of mineral origin come from well-known crude oil refining processes such as, for example, distillation, deparaffinization, deasphalting, dearomatization and hydrogenation.

Oils of synthetic origin preferably include hydrocarbon oils such as, for example, polymerized and hydrogenated terminal or internal olefins; alkylbenzenes; polyphenyls; alkylated diphenyl ethers; polyalkylene glycols and derivatives, where the terminal hydroxyl groups have been modified for example by esterification or etherification.

Another class of synthetic lubricant oils preferably comprises esters of carboxylic acids, either synthetic or of animal or vegetable derivation with a variety of alcohols or polyols.

A further class of synthetic lubricant oils preferably comprises the esters of carbonic acid with a variety of alcohols and polyols.

Preferably the vegetable oils are selected from soy, palm and castor oils, whereas the oils of animal origin are preferably selected from suet, lard or whale oil.

Another method for the classification of the base oils is the one defined by the American Petroleum Institute (API) in the publication "Engine Oil Licensing and Certification System" (API EOLCS, 1507—Industry Services Department, Fourteenth Edition, December 1996, Addendum 1, December 1998). The base oils are divided into five groups as a function of their chemical/physical and compositional characteristics.

According to this classification, the base oils comprised in the detergent compositions described and claimed can belong to all of the aforesaid API groups, preferably to the API groups selected between I, II, III or IV and even more preferably to the API groups selected between I, II or III.

The detergent compositions, described and claimed in the present patent application, can further comprise one or more metal salts of acidic organic compounds selected from:

A) overbased metal salts of carboxylic, dicarboxylic and polycarboxilic acids containing a number of carbon atoms comprised between 6 and 80, preferably of alkyl-carboxylic acids of formula (IV):

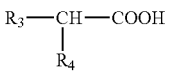

(IV)

wherein:

$R_3$ can be selected from a linear or branched alkyl or alkylene group, containing a number of carbon atoms comprised between 6 and 40 and preferably between 10 and 24;

$R_4$ can be selected from hydrogen, an alkyl group containing from 1 to 4 carbon atoms, or —$CH_2COOH$.

More preferred saturated carboxylic acids of formula (IV) can be selected from capric acid, lauric acid, myristic acid, stearic acid, isostearic acid, arachidic acid, behenic acid and lignoceric acid.

More preferred unsaturated carboxylic acids of formula (IV) can be selected from lauroleic acid, myristoleic acid, palmitoleic acid, oleic acid, gadoleic acid, erucic acid, linoleic acid and linolenic acid. Mixtures of both synthetic and natural organic acids can be used, containing both saturated and unsaturated acids.

Particularly preferred carboxylic acids are stearic acid and isostearic acid.

B) overbased metal salts of sulfonic acids of formula $(R_5)_q$-G-$SO_3H$ (V) wherein:

$R_5$ is a linear or branched alkyl group containing 6 to 40 carbon atoms, i.e. $R_5$ is an alkyl substituent derived from a polymer of a $C_2$-$C_6$ olefin;

G is a $C_6$-$C_{20}$ aromatic hydrocarbon, an aliphatic hydrocarbon containing 5 to 20 carbon atoms. Preferably G is benzene, naphthalene, toluene, xylene and more preferably benzene;

q is zero or an integer comprised between 1 and 5, preferably 1, 2 or 3, more preferably 1 or 2.

Preferred sulfonic acids that can be used are selected from di-alkyl benzene sulfonic acids and mono-alkyl benzene sulfonic acids. Preferred di-alkyl benzene sulfonic acids include: di-nonyl benzene sulfonic acid, di-decyl benzene sulfonic acid, di-undecyl benzene sulfonic acid, di-dodecyl benzene sulfonic acid, di-alkyl benzene sulfonic acids that contain alkyl substituents derived from polypropylene, polyisobutene and poly-1-butene, or mixtures of the aforesaid acids. Examples of mono-alkyl benzene sulfonic acids that can be used are those that contain alkyl substituents derived from polypropylene, polyisobutene or mixtures of the aforesaid acids.

Preferred sulfonic acids have a sulfonic acid content, expressed as a percentage by weight with respect to the total weight of the mixture constituted by sulfonic acid, by an aliphatic or aromatic hydrocarbon from which the sulfonic acids derive and sulphuric acid comprised between 50% and 99%, preferably between 60% and 90% and have a sulphuric acid content less than 5% by weight, preferably less than 2%.

C) overbased metal salts of salicylic acids substituted with linear or branched alkyl groups, in a number comprised between 1 and 3, each containing a number of carbon atoms comprised between 2 and 40, preferably alkyl salicylic acids of formula:

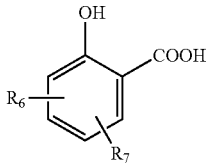

(VI)

wherein $R_6$ and $R_7$ may be selected independently from hydrogen and an alkyl group containing a number of carbon atoms comprised between 2 and 40, more preferably between 4 and 24.

Preferred substituted alkyl salicylic acids are those that contain alkyl substituents derived from polypropylene, polyisobutene and poly-1-butene.

When comprised in the detergent composition, the overbased metal salts of carboxylic acids (A) may be present at a concentration, expressed as a percentage by weight of said overbased metal salts, on the detergent composition, comprised between 1% and 80%, preferably between 5% and 60%.

When comprised in the detergent composition, the overbased metal salts of sulfonic acids (B) may be present at a concentration, expressed as a percentage by weight of said overbased metal salts, on the detergent composition, comprised between 1% and 80%, preferably between 5% and 60%.

When comprised in the detergent composition, the overbased metal salts of salicylic acids (C) may be present at a concentration, expressed as a percentage by weight of said overbased metal salts, on the detergent composition, comprised between 1% and 80%, preferably between 5% and 60%.

The metal of the overbased metal salts of the organic acids A), B) and C) is an alkali metal or an alkaline-earth metal.

The preferred metals are alkaline-earth metals, particularly preferred are magnesium and calcium, even more preferred is calcium. Preferably, the metal is the same as the metal salts of the calixarenes of formula (I).

The overbased metal salts of the organic acids (A), (B) and (C) are characterized by a metal content corresponding to a ratio between the metal equivalents and those of the organic acid comprised between 1.1 and 15, preferably between 1.5 and 8.

In the overbased metal salts of the organic acids A), B) and C) the excess metal with respect to the organic acid is in the form of metal carbonate and metal hydroxide, preferably of calcium or magnesium, even more preferably of calcium.

The overbased metal salts of the organic acids A), B) and C) comprise neutral metal salts of organic acids at a concentration, expressed as a percentage by weight with respect to said overbased metal salts of the organic acids, comprised between 10% and 90%, more preferably between 20% and 80%.

The overbased metal salts of the organic acids A), B) and C) comprise the metal carbonate at a concentration, expressed as a percentage by weight with respect to said overbased metal salts of the organic acids, comprised between 5% and 80%, more preferably between 10% and 60%.

The overbased metal salts of the organic acids A), B) and C) may also comprise calcium hydroxide at a concentration, expressed as a percentage by weight with respect to said overbased metal salts of the organic acids, comprised between 0.5% and 15%, more preferably between 2% and 8%.

The Applicant now describes in detail all the steps of the process for preparing detergent compositions containing overbased metal salts of calixarenes of formula (I) using the mixture of compounds obtained with the process described and claimed in the present patent application.

Said mixture of compounds is used, without further purifications, directly as a reactant in the salification reaction with an excess of metal base forming a first intermediate mixture (INTERMEDIATE MIX 1). Subsequently, water is added to the first intermediate mixture forming a second intermediate mixture (INTERMEDIATE MIX 2) and then, said second intermediate mixture is reacted with carbon dioxide, according to a carbonation reaction which converts the unreacted metal base into metal carbonate.

The quantity of water which is added subsequently to the salification reaction and before the carbonation reaction, expressed as a percentage by weight with respect to the total weight of the mixture subjected to carbonation, is comprised between 0.1% and 4%, preferably comprised between 0.3% and 2%.

The addition of water has the function of promoting the carbonation reaction and controlling the viscosity of the detergent composition, preventing too high viscosity values. The addition of too much water leads to an unstable product characterized by high turbidity.

The process for the preparation of detergent compositions described and claimed can further comprise a step of maturation of the obtained mixture, after the carbonation reaction with carbon dioxide, wherein the mixture can be maintained stirred for a certain interval of time at a certain temperature.

After the carbonation and possible maturation it is possible to proceed to a subsequent recovery step of the detergent composition, removing by distillation the solvents and proceeding with a purification step by filtration and/or centrifugation of the detergent composition.

In the process for the preparation of detergent compounds described and claimed, the temperature at which the salification reaction can be performed is preferably comprised between 30° C. and 200° C., more preferably comprised between 40° C. and 160° C. The selection of the optimal temperature depends on the nature of the reaction solvent used.

In the process for the preparation of detergent compositions described and claimed, the pressure during the salification reaction is preferably comprised between 0.01 bar and 1.5 bar absolute, more preferably between 0.04 bar and 1.2 bar absolute.

The carbonation reaction with carbon dioxide can preferably be performed at a temperature comprised between 15° C. and 180° C., more preferably between 20° C. and 150° C. The addition of carbon dioxide as a gas can be performed in a time comprised between 10 minutes and 6 hours, more preferably between 1 hour and 4 hours. The absolute pressure at which the carbonation reaction can be performed is preferably comprised between 1 bar absolute and 5 bar absolute, more preferably between 1 bar absolute and 2 bar absolute.

Once the carbonation is finished, it is possible to proceed to the maturation of the reaction mixture, which is an optional operation, and which can be performed at a temperature comprised between 40° C. and 160° C.

The maturation step can be performed for a time comprised between 10 and 3 hours, preferably between 20 minutes and 2 hours.

The calixarenes of general formula (I) can also be obtained in a mixture with one or more solvents: also in this case the mixture of compounds can be used directly as a reactant in the salification reaction with excess metal base.

Preferred solvents in mixture with calixarenes of formula (I) can be selected from among aromatic hydrocarbons with a number of carbon atoms comprised between 6 and 16, more preferably selected between toluene, xylene and tetraline; aliphatic or cycloaliphatic hydrocarbons with a number of carbon atoms comprised between 7 and 16, more preferably selected from decane or decaline; alkyl, aryl-alkyl and aromatic ethers with a number of carbon atoms comprised between 8 and 16, such as, for example, anisole and diphenyl ether. Preferred solvents are toluene or xylene. The total concentration of calixarenes of formula (I), including impurities of alkyl phenol (II) and linear oligomers (III) and expressed as a percentage by weight with respect to the solution also comprising the solvent, is preferably comprised between 20% and 90%, more preferably comprised between 40% and 60%.

During the process for the preparation of detergent compositions containing overbased metal salts of calixarenes of formula (I), regardless of the order, a reaction solvent, or mixture thereof, can be added.

During the process for the preparation of detergent compositions containing overbased metal salts of calixarenes of formula (I), regardless of the order, a lubricant base oil, or mixtures thereof, can be added.

During the process for the preparation of detergent compositions containing overbased metal salts of calixarenes of formula (I), regardless of the order, an organic acid, or mixtures thereof, can preferably be added.

The metal base is preferably a basic compound of an alkaline-earth metal, or an alkali metal.

For the purposes of the present disclosure, the alkali metals that can be used are preferably selected from Li, Na, K, Rb e Cs; the alkaline-earth metals that can be used are preferably selected from Be, Mg, Ca, Sr and Ba. More preferred is a basic compound of an alkaline-earth metal selected more preferably from calcium or magnesium, even more preferably a basic calcium compound. The metal base is preferably an oxide or hydroxide of an alkaline-earth or alkali metal, more preferably an oxide or a hydroxide of an alkaline-earth metal, more preferably selected from calcium or magnesium, even more preferably it is calcium hydroxide.

The metal base may preferably be added in full at the start of the process for preparing the detergent composition, or can be added in part at the start and in part at different intermediate moments of the process for preparing the detergent compositions described and claimed. Preferably the metal base is supplied with a single addition at the start of the process.

The quantity of metal base used in the process for preparing the detergent composition described and claimed can preferably correspond to a ratio that varies between 1.1 and 15, more preferably comprised between 1.5 and 8, said ratio being calculated between the base equivalents and the sum of the calixarene equivalents of formula (I) and the optional acidic organic compound, or the mixture of optional acidic organic compounds.

Acidic organic compounds, which can be used as optional reactants in the process described and claimed for the preparation of detergent compositions can preferably be selected from among the following classes of compounds and mixtures thereof.

Organic acids can preferably be selected from among saturated or unsaturated carboxylic acids and saturated or unsaturated polycarboxylic acids containing a number of carbon atoms comprised between 6 and 100.

Most preferred are alkyl-carboxylic acids of formula (IV):

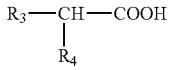

(IV)

wherein:

$R_3$ can be selected from a linear or branched alkyl or alkylene group, containing a number of carbon atoms comprised between 6 and 40 and preferably between 10 and 24;

$R_4$ can be selected from hydrogen, an alkyl group containing from 1 to 4 carbon atoms, or —$CH_2COOH$.

More preferred saturated carboxylic acids of formula (IV) can be selected from capric acid, lauric acid, myristic acid, stearic acid, isostearic acid, arachidic acid, behenic acid and lignoceric acid.

More preferred unsaturated carboxylic acids of formula (IV) can be selected from lauroleic acid, myristoleic acid, palmitoleic acid, oleic acid, gadoleic acid, erucic acid, linoleic acid and linolenic acid. Mixtures of both synthetic and natural organic acids can be used, containing both saturated and unsaturated acids.

Particularly preferred carboxylic acids are stearic acid and isostearic acid.

Organic acids can preferably be selected from sulfonic acids of formula ($R_5$) q-G-$SO_3H$ (V) wherein:

$R_5$ is a linear or branched alkyl group containing 6 to 40 carbon atoms, i.e. $R_5$ is an alkyl substituent derived from a polymer of a $C_2$-$C_6$ olefin;

G is a $C_6$-$C_{20}$ aromatic hydrocarbon, an aliphatic hydrocarbon containing 5 to 20 carbon atoms. Preferably G is benzene, naphthalene, toluene, xylene and more preferably benzene;

q is zero or an integer comprised between 1 and 5, preferably 1, 2 or 3, more preferably 1 or 2.

Preferred sulfonic acids that can be used are selected from di-alkyl benzene sulfonic acids and mono-alkyl benzene sulfonic acids. Preferred di-alkyl benzene sulfonic acids include: di-nonyl benzene sulfonic acid, di-decyl benzene sulfonic acid, di-undecyl benzene sulfonic acid, di-dodecyl benzene sulfonic acid, di-alkyl benzene sulfonic acids that contain alkyl substituents derived from polypropylene, polyisobutene and poly-1-butene, or mixtures of the aforesaid acids. Examples of mono-alkyl benzene sulfonic acids that can be used are those that contain alkyl substituents derived from polypropylene, polyisobutene or mixtures of the aforesaid acids.

Preferred sulfonic acids have a sulfonic acid content, expressed as a percentage by weight with respect to the total weight of the mixture constituted by sulfonic acid, by an aliphatic or aromatic hydrocarbon from which the sulfonic acids derive and a sulphuric acid comprised between 50% and 99%, preferably between 60% and 90% and have a sulphuric acid content less than 5% by weight, preferably less than 2%.

Organic acids can preferably be selected from salicylic acids substituted with linear or branched alkyl groups, in a number comprised between 1 and 3, each containing a number of carbon atoms comprised between 2 and 40, preferably alkyl salicylic acids of formula:

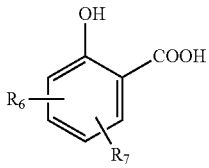

(VI)

wherein $R_6$ and $R_7$ may be selected independently from hydrogen and an alkyl group containing a number of carbon atoms comprised between 2 and 40, more preferably between 4 and 24.

Preferred substituted alkyl salicylic acids are those that contain alkyl substituents derived from polypropylene, polyisobutene and poly-1-butene.

Preferred organic acids are alkyl carboxylic acids of formula (IV) and more preferably stearic acid and sulfonic acids of formula (V), more preferably mono-alkyl-benzene sulfonic acids and di-alkyl-benzene sulfonic acids containing alkyl substituents derived from polypropylene.

The organic acid can also be a mixture of the aforesaid organic acids. Preferred mixtures of organic acids are those of alkyl carboxylic acids with alkyl-benzene sulfonic acids such as, for example, the mixture of stearic acid with mono-alkyl-benzene sulfonic acids.

Acidic organic compounds can also be present in a mixture with a solvent, or a mixture of solvents. Said solvent can preferably be selected from aromatic hydrocarbons with a number of carbon atoms comprised between 6 and 16, more preferably between toluene, xylene and tetraline; or selected from aliphatic or cycloaliphatic hydrocarbons with a number of carbon atoms comprised between 7 and 16, more preferably from decane and decaline; or selected from alkyl, aryl-alkyl and aromatic ethers with a number of carbon atoms comprised between 8 and 16, more preferably between anisole and diphenyl ether; or selected from aliphatic or aromatic ketones with a number of carbon atoms comprised between 4 and 20; or selected from esters of carboxylic acids with a number of carbon atoms comprised between 4 and 20; or selected between alcohols with a number of carbon atoms comprised between 4 and 20, and mixtures thereof. The preferred solvents are xylene and toluene.

Said acidic organic compounds are preferably introduced in a quantity that is comprised between 5% and 80%, preferably between 10% and 70%, said quantity being calculated as a percentage by weight of the acidic organic compound, or of the mixture of acidic organic compounds, excluded the solvent, with respect to the mixture containing said acidic compound, or mixtures thereof, and the mixture of compounds containing the calixarene of formula (I), excluding solvents. The salification reaction between the calixarene of general formula (I) and the metal base can be performed in the presence of a reaction solvent, or a mixture thereof, which is not necessarily the one possibly present in mixture with the calixarenes of formula (I) or with the acidic organic compounds.

Said reaction solvents can preferably be selected from:

- an alcohol with an acyclic or cyclic alkyl chain, or an alkyl aryl chain, containing a number of carbon atoms comprised between 1 and 16; more preferably selected from methanol, ethanol, propanol, isopropanol, butanol, cyclohexane, 2-ethyl hexanol, dodecanol, benzyl alcohol;
- a poly-hydroxylated aliphatic hydrocarbon having a number of carbon atoms comprised between 2 and 4; more preferably selected from ethylene glycol, propylene glycol or glycerine;
- a di-alkylene glycol or a tri-alkylene glycol wherein the alkylene group contains from 2 to 4 carbon atoms, more preferably selected from diethylene glycol, dipropylene glycol or triethylene glycol;
- a mono-alkylene glycol alkyl ether, or a poly-alkylene glycol alkyl ether of formula (VII):

$$R_8O—(R_9O)_r—R_{10} \quad \text{(VII)}$$

wherein $R_8$ is an alkyl group containing a number of carbon atoms comprised between 1 and 6; $R_9$ is a bivalent group containing carbon and hydrogen with a number of carbon atoms comprised between 2 and 4; $R_{10}$ is hydrogen or an alkyl group with a number of carbon atoms comprised between 1 and 6; r is an integer comprised between 1 and 6; more preferred are monomethylethers, dimethylethers of ethylene glycol, of diethylene glycol, of triethylene glycol or of tetraethylene glycol, and mixtures thereof.

- water;
- a ketone with alkyl or alkyl-aryl, or aromatic groups, each containing a number of carbon atoms comprised between 1 and 10; more preferably selected from acetone, methyl ethyl ketone, methyl isobutyl ketone, cyclohexane or acetophenone;
- an ester of an aliphatic or aromatic carboxylic acid with a number of carbon atoms comprised between 1 and 10, more preferably selected from ethyl acetate and butyl acetate;
- an aromatic or aliphatic hydrocarbon with a number of carbon atoms comprised between 5 and 16;
- and mixtures thereof.

The aromatic hydrocarbon solvent is preferably selected from benzene, substituted benzenes and mixtures thereof; more preferably it is selected from toluene, xylene or halogen benzenes and mixtures thereof. The aliphatic hydrocarbon solvent is preferably selected from aliphatic paraffins, cycloaliphatic paraffins and mixtures thereof; more preferably it is selected from hexane, heptane and mixtures thereof.

In the process for preparing detergent compositions described and claimed, a single reaction solvent can be used, but more preferably a mixture of reaction solvents is used.

Said mixture of reaction solvents can comprise one or more reaction solvents able to dissolve the calixarenes of formula (I) and, if present, the acidic organic compounds and mixtures thereof; and one or more polar reaction solvents able to dissolve, at least in part, the metal base. The reaction solvent or mixture of reaction solvents able to dissolve the calixarenes of formula (I), the acidic organic compounds and mixtures thereof, is preferably selected from toluene, heptane, 2-ethylhexyl alcohol, cyclohexanone and butyl acetate. The reaction solvent or mixture of reaction solvents able to dissolve, at least in part, the metal base is preferably selected from ethylene glycol, methanol, glycerine and diethylene glycol monomethyl ether.

Preferred mixtures of reaction solvents are the mixture of ethylene glycol with 2-ethyl hexanol, the mixture of glycerine with 2-ethyl hexanol and the mixture of methanol with toluene.

In a preferred embodiment the reaction solvent is the mixture constituted by ethylene glycol and 2-ethyl hexyl alcohol, containing a quantity of ethylene glycol, expressed as a percentage by weight on the mixture of solvents, comprised between 3% and 50%, preferably between 7% and 30%.

The reaction solvent or mixture of reaction solvents is added in a quantity corresponding to a percentage by weight, comprised between 10% and 90%, preferably between 30% and 70%, calculated with respect to all the components of the reaction mixture.

The ethylene glycol can be added in full, together with the 2-ethyl hexyl alcohol, at the start of the reaction with the excess of metal base, or it can be fractionated, by adding it separately from the 2-ethyl hexyl alcohol in part at the start and in part during the reaction with the excess of metal base and in part prior to the subsequent carbonation reaction with carbon dioxide. The ethylene glycol is preferably added in part during the reaction with the excess of metal base and in part prior to the subsequent carbonation reaction.

During the process for the preparation of detergent compounds, described and claimed in the present text, a lubricant base oil can be added, or mixtures of lubricant base oils, which can be selected from base oils of mineral, synthetic, vegetable or animal origin and mixtures thereof.

The lubricant base oil acts as a solvent for the metal salts of calixarenes and, if present, for the metal salts of organic acids, allowing a colloidal dispersion of said metal salts in the lubricant base oil to be obtained.

The base oils used are those previously described in the text.

The lubricant base oil or mixture of lubricant base oils are used at a concentration, expressed as a percentage by weight of the base oil on the entire reaction mixture, comprised between 3% and 80%, preferably between 6% and 50%.

Carbon dioxide can preferably be added subsequently to every addition of the metal base, or can preferably be added subsequently to the addition of the entire metal base in two or more subsequent stages. Preferably, carbon dioxide is added in a single stage, subsequently to a single addition of the entire quantity of the metal base.

Carbon dioxide can preferably be added as a gas or solid, preferably as a gas.

The quantity of carbon dioxide used preferably corresponds to a ratio between equivalents of carbon dioxide and those of the metal base in excess with respect to the equivalents of the compounds to be neutralized, comprised between 0.6 and 4, more preferably between 0.8 and 3. In a preferred form of the disclosure, carbon dioxide is used in a quantity such as to obtain a carbonation percentage of the calcium hydroxide available comprised between 60% and 99%, more preferably between 80% and 95%, so as to obtain stable products and with high incorporation efficiency of the calcium carbonate.

The process for the preparation of the detergent compounds described and claimed may be performed by adding the individual reactants, reaction solvents and lubricant base oil in any order, provided that the carbon dioxide is added subsequently to the metal base and that the water is added prior to the carbonation. The metal base and carbon dioxide can preferably be added with a single addition or proceeding with fractioned additions, more preferably with a single addition.

The product is obtained as a solution in lubricant base oil separating the water and the solvent by distillation.

The distillation of solvents can be performed by increasing the temperature to a maximum value of 230° C., preferably up to 200° C. and maintaining the product at such temperature for the necessary time to obtain the complete removal of the solvents. The distillation of the solvents can be performed at atmospheric pressure, or at reduced pressure, preferably at reduced pressure.

At the end a solvent can be added to the product, preferably xylene or toluene, or 2-ethyl hexanol or heptane, more preferably xylene or toluene in a quantity, expressed as a weight percentage of the solvent on the weight of the product and solvent mixture, comprised between 10% and 80%. Then the centrifugation takes place, preferably with a disc centrifuge, at a temperature comprised between 20° C. and 100° C. At the end the solvent is removed by distillation at a temperature comprised between 100° C. and 230° C., preferably between 150° C. and 210° C., operating at atmospheric pressure or at reduced pressure, more preferably at atmospheric pressure.

In a further preferred embodiment, the process for preparing detergent compositions comprises the following steps:

performing a condensation reaction between alkylphenol and formaldehyde in aqueous solution at a certain temperature comprised between 70° C. and 125° C., at an absolute pressure that ranges from 1 bar to 5 bar, and for a reaction time that ranges from 1 hour to 5 hours; for forming a first intermediate product (INTERMEDIATE 1), in the presence of a basic catalyst, in the absence of solvent and without removal of the water present in the aqueous solution of formaldehyde and which is formed during the condensation reaction; subsequently distilling said first intermediate product (INTERMEDIATE 1), increasing the temperature up to a maximum of 130° C. inclusive and thus partially removing the water deriving from the aqueous formaldehyde solution and from the condensation reaction, to form a second intermediate (INTERMEDIATE 2); subsequently adding to the second intermediate product (INTERMEDIATE 2) a solvent, preferably a portion of the solvent and completing the condensation reaction without further removal of the water, forming a third intermediate product (INTERMEDIATE 3) which contains linear oligomers having formula (III), wherein R is preferably the alkyl dodecyl group (tetrapropenyl), $R_1$ and $R_2$ may be hydrogen, or the hydroxymethylene group (—$CH_2OH$), and p is preferably comprised between 0 and 4;

(III)

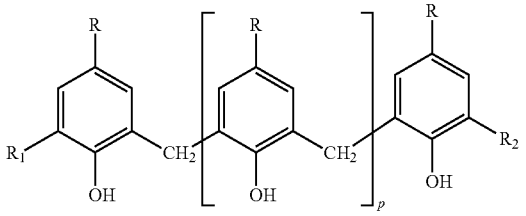

then adding the remaining portion of the solvent to said third intermediate product (INTERMEDIATE 3) and completely removing the water present in the third intermediate product by distillation, forming by cyclization of the linear oligomers a final mixture that contains the mixture of compounds for detergent compositions, solvent and sediments; subsequently separating said sediments, preferably by filtration or extraction with demineralized water, from said final mixture: subsequently distilling the resulting mixture, totally removing the residual water and partially or totally the reaction solvent.

reacting said mixture of compounds for detergent compositions with an excess of metal base forming a first intermediate mixture (INTERMEDIATE MIX 1), and subsequently adding water to the first intermediate mixture forming a second intermediate mixture (INTERMEDIATE MIX 2) and then, reacting said second intermediate mixture with carbon dioxide, according to a carbonation reaction which converts the unreacted metal base into metal carbonate, forming the detergent composition.

In a further preferred embodiment, the process for preparing detergent compositions comprises the following steps:

mixing the mixture of compounds containing the calixarene of formula (I) and optionally containing solvent, described and claimed in the present patent application, with a lubricant base oil, or with a mixture thereof, thus forming a mixture of reactants;

optionally removing by distillation any solvent present in the mixture of reactants;

adding to said mixture of reactants a part of a reaction solvent, or a part of a mixture thereof, preferably 2-ethyl hexyl alcohol and ethylene glycol, and subsequently adding a metal base in excess;

removing by distillation the reaction water formed, thus forming a second mixture;

optionally adding an acidic organic compound, or a mixture thereof, and removing by distillation the reaction water that has formed, forming a third mixture;

adding to said third mixture a further part of reaction solvent, or a further part of a mixture of reaction solvents; preferably ethylene glycol and water thus forming a new mixture;

then proceeding with the carbonation reaction between the previous mixture and carbon dioxide.

preferably the composition thus obtained is also subjected to a maturation step. After carbonation and possible maturation, the subsequent step of recovering the product is performed, removing the solvents by distillation and proceeding with the centrifugation of the product.

In a further preferred embodiment, the process for preparing detergent compositions comprises the following steps:

- mixing the mixture of compounds containing the calixarene of formula (I) and optionally containing solvent, described and claimed, in the present patent application, with a lubricant base oil, or a mixture of lubricant base oils and optionally adding an organic acid thus forming a mixture of reactants;
- optionally removing by distillation any solvent present in the mixture of reactants;
- subsequently adding to said mixture of reactants an excess of metal base with respect to the reactants and a part of reaction solvent, or a part of a mixture of reaction solvents, preferably 2-ethyl hexyl alcohol and ethylene glycol, and removing by distillation the reaction water formed, forming a second mixture;
- adding to said second mixture a second organic acid and optionally removing by distillation the reaction water formed, forming a third mixture;
- adding to the previous mixture a further part of reaction solvent, or a further part of a mixture of reaction solvents, preferably a second portion of ethylene glycol and a portion of water, forming a new mixture;
- then proceeding with the carbonation reaction between the previous mixture and carbon dioxide.

The process described above for the preparation of the detergent compositions described and claimed in the present patent application enables detergent compositions to be obtained with a content of overbased metal salts of calixarenes of formula (I), expressed as a percentage by weight with respect to the detergent composition, comprised between 10% and 90%, preferably between 15% and 75%.

Said process further enables detergent compositions to be obtained with an alkyl phenol content and the corresponding metal salt thereof, expressed as a sum of the percentages by weight of the alkyl phenol and its metal salt with respect to the weight of the detergent composition, less than or equal to 0.29%, preferably less than or equal to 0.2%.

Said process further enables detergent compositions to be obtained with a content of overbased metal salts of linear oligomers of formula (III), expressed as a percentage by weight with respect to the weight of the detergent composition, less than or equal to 15%, preferably less than or equal to 5%.

Said process further enables detergent compositions to be obtained with high alkalinity, with a Total Base Number (TBN) value, expressed in mg KOH/g, comprised between 120 and 550, preferably comprised between 150 and 500.

Said process further allows the kinematic viscosity value at 100° C. of the detergent composition to be controlled, maintaining the value of such parameter below 600 $mm^2/s$, preferably below 500 $mm^2/s$.

Further subject matter according to the present disclosure is also lubricant compositions (lubricant formulations) containing the detergent compositions described and claimed in the present text, a lubricant base oil, or a mixture of lubricant base oils. The detergent compositions described and claimed in the present text are additives able to guarantee excellent control of the formation of deposits and effective neutralization of the inorganic and organic acidity, which are generated in the lubricant, thus allowing control over wear and corrosion phenomena.

Lubricant formulations can contain, as well as the detergent compositions according to the disclosure, other detergent additives such as, for example, neutral and overbased alkyl benzenesulfonates of calcium and magnesium, viscosity improver additives, antioxidant additives, friction modifier additives, anti-wear additives and extreme pressure additives (EP additives), corrosion inhibitors, pour point depressant additives, foam inhibitors, emulsifiers and the like.

The lubricant compositions according to the present disclosure contain the detergent compositions described and claimed in the text, at a total concentration, expressed as a percentage by weight of said detergent compositions on the lubricant composition, comprised between 0.1% and 50%, preferably between 0.5% and 30%, even more preferably between 1% and 20%.

Further subject matter of the present disclosure is constituted by lubricant formulations containing the detergent compositions described and claimed in the present text, for applications such as lubricants for the automotive industry that are highly compatible for the post-treatment devices of the exhaust gases of motor vehicles for reducing pollutant emissions.

It is known that in order to reduce pollutant emissions, motor vehicles must be equipped with exhaust gas treatment systems constituted by anti-particulate filters and/or devices containing catalysts.

The lubricant oil that leaks in a small part into the combustion chamber contains elements such as sulphur and phosphorus and metals such as calcium, magnesium and zinc that lead to a reduction in the efficiency of such devices. Vehicles with gasoline powered engines are equipped with a three-way catalyst based on noble metals for the reduction of CO, unburned hydrocarbons (HC) and nitrogen oxides (NOx). Such devices can suffer from efficiency losses due to the poisoning of the catalysts by elements such as sulphur and phosphorus.

Vehicles with diesel powered engines are provided with catalytic systems for controlling NOx emissions (LNT or SCR devices) and CO/HC emissions (DOC devices), both sensitive to sulphur and phosphorus.

Diesel engines and more recent gasoline engines with direct injection further require particulate filters that get clogged due to the effect of the inorganic metal components (ash) deriving from the combustion of the lubricant of which small quantities leak into the combustion chamber. The trend of the lubricant to form inorganic ash is expressed by the "sulfated ash" parameter.

To guarantee the efficiency over time of such emission treatment systems the lubricants must therefore contain low levels of sulphated ash, sulphur and phosphorus (Low SAPS oils where SAPS means Sulphated Ash, Phosphorus, Sulphur). In engine oil the phosphorus essentially derives from anti-wear additives (ZDDP i.e. dialkyl dithiophosphates of Zn) but, as well as from anti-wear additives, the sulphur can also derive from lubricant bases and detergent compositions of the calcium sulfonate type.

Metals that generate ash mainly derive from anti-wear additives and from detergent compositions.

Lubricants containing detergent compositions based on calixarenes have a low sulphur content that guarantees high compatibility with catalytic devices and a reduced ash content thanks to their high detergent performance levels that enable a reduction in their quantity of use.

Further subject matter of the present disclosure is lubricant formulations containing the detergent compositions described and claimed in the present text, for applications such as lubricants for marine engines with high engine performance levels.

In this sector the evolution of the engines resulting from stricter regulations on emissions and types of fuels has led to stricter performance levels for lubricants and detergent additives based on sulfonated substances are no longer suited to satisfy the new requirements, in particular in the sector of 4-stroke engines.

Lubricants containing detergent compositions based on calixarenes enable oils to be formulated for large marine engines that can satisfy stricter performance requirements in terms of deposits, oxidation and wear and are advantageous with respect to traditional technology lubricants.

Further subject matter of the present disclosure is constituted by lubricant formulations containing the detergent compositions described and claimed in the present text, as lubricants for industrial applications and in particular as oils for gears.

In this sector energy efficiency guides the evolution of transmission apparatuses and the related lubricants. The contribution of the lubricant to the efficiency of the transmissions can take place through the maintenance of the optimal viscosity in the widest range of temperatures and through the reduction of friction, however ensuring maximum protection against wear on the mechanical components.

Detergent compositions based on calixarenes significantly contribute to the reduction in friction and the protection against wear and allow transmission oils to be formulated with higher anti-friction and anti-wear characteristics than those that can be obtained with traditional technology formulations.

Some application examples of the present disclosure are now described, which have a purely descriptive and non-limiting purpose and which represent preferred embodiments.

EXAMPLES

Synthesis of Calixarenes

Examples 1 and 2 relate to the synthesis of p-dodecyl calix[4,5,6,7,8]arene. In particular, example 1 relates to the process for producing said calixarene with high yields and low unreacted alkyl phenol (tetrapropenylphenol) and linear oligomers content, according to the process described in the present patent application.

Comparative example 2 is an example in which the operating conditions of example 1 of WO 2017/025900 are applied, which do not enable products to be obtained with high yields and with unreacted low alkyl phenol content.

In such examples, the condensation reaction between p-alkyl phenol, in particular branched p-dodecyl phenol (tetrapropenylphenol) and formaldehyde is performed in an RC-1 Mettler calorimeter constituted by a 5-neck jacketed glass reactor, with a volume of 2 litres, thermostated by circulation in the jacket of a fluid coming from a thermostatic bath internal to the instrument. The reactor is provided with: a mechanical blade stirrer; a coil condenser cooled to the temperature of 10° C. with thermo-cryostat; a Dean Stark condenser, cooled to the temperature of 10° C. with thermo-cryostat, connected to a nitrogen line and provided with a container cooled to the temperature of 10° C. for collecting the distillate; discharge with bottom provided with a teflon tap; thermocouple for measuring the temperature. The entire system is controlled by an interface connected to a computer, which enables the reactor to be automated by setting the desired heating and cooling programs.

The concentration of unreacted tetrapropenylphenol (TPP) in the calixarene is determined by means of reversed phase liquid chromatography (HPLC). The samples to be analysed through HLPC were prepared by completely removing the xylene and then diluting the residue so as to obtain 10% w/w solutions of dry product in heptane. The HPLC system used is comprised of an HPLC pump, an oven for thermostating the column, a UV-visible HPLC detector, an autosampler and a PC provided with software for the acquisition and processing of chromatography data. In particular, the system used is Agilent 1260 HPLC Infinity II with Chemstation software. The column used is the Perkin Elmer Ultra C8 5 μm (150 mm×4.6 mm). The HPLC method for the determination of the residual tetrapropenylphenol envisages the following operating conditions:

Pump flow: 0.7 ml/min

UV visible detector wavelength: 288 nm

Thermostating temperature of the column: 40° C.

Injection volume: 5 μl

Mobile phases: A: ethanol/H2O 85/15; B: ethyl acetate/ethanol/H2O 86/10/4

Mobile phase composition: 0-7 min A=100%, B=0%; 7-17 min A=0%, B=100%

The chromatogram typically contains different peaks (see FIG. 1). Those related to TPP elute in low times. For the quantification of the TPP, the area of the related peaks is compared with that of standard solutions at known TPP concentration, which are used for constructing the calibration curve, from which the concentration of TPP is obtained for the unknown samples.

The sum of the molar percentages of TPP and linear oligomers was instead determined through 1H-NMR analysis. For such determination it was considered that the linear oligomers have formula (III) reported in the text of the present patent application with $R{=}C_{12}H_{25}$ and $R_1{=}R_2{=}H$. This hypothesis is confirmed by the fact that the $^{13}$C-NMR analysis on the product deriving from the condensation of TPP and formaldehyde has always highlighted negligible concentrations (<0.1% mol/mol) of linear oligomers with R1 or R2 groups of the $—CH_2OH$ type.

The $^1$H-NMR spectra were performed on samples dissolved in $CDCl_3$ using the Varian-500 instrument.

Figure 2:
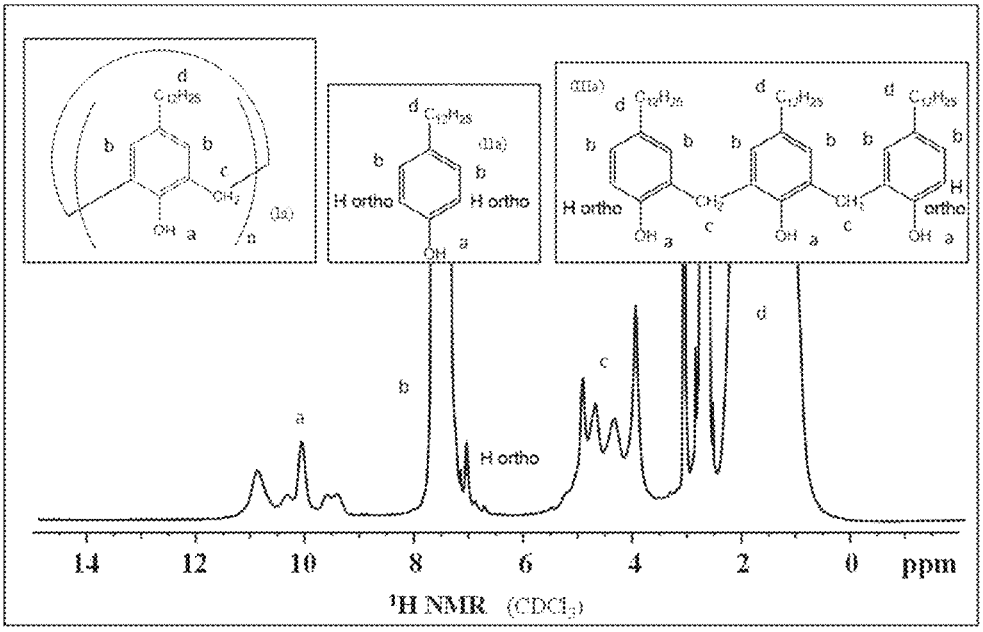
FIG. 2 illustrates the $^{1}$HNMR spectrum related to the analysis for the determination of the TPP and linear oligomer content, expressed as a sum of molar percentages.

The $^1$H-NMR method for the determination of the sum of the molar percentages of TPP (IIa) and of the linear oligomers (IIIa) is based on the fact that, unlike calixarenes (Ia), both of said compounds provide in the 1H-NMR spectrum, signals in the region of 6.5-7.0 ppm, due to the hydrogens in the ortho position with respect to phenol hydroxyl, as verified by the 1H-NMR spectra of pure TPP and the pure calixarene (see FIG. 2).

For calculating the molar percentage of TPP+linear oligomers, the following formula is applied:

$$TPP + \text{linear oligomers (molar \%)} = \frac{(\text{integral of hydrogens } ortho/2)}{(\text{integral of hydrogens C12H25/25})} \times 100$$

(IIA)

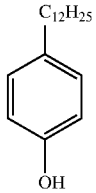

-continued (IIIA)

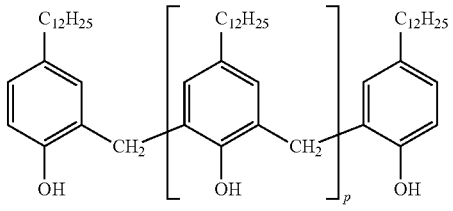

(IA)

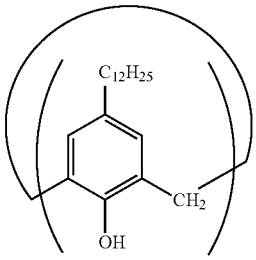

After determining in the condensation product of TPP with formaldehyde, through HPLC, the percentage by weight of TPP and, through $^{1}$H-NMR, the sum of the molar percentages of TPP and of linear oligomers and by difference the molar percentage of calixarenes, the percentage by weight of linear oligomers is calculated. For the latter calculation it is considered that the preponderant linear oligomer is the trimer (p=1) corresponding to a molecular weight of 811.13 g/mol, as highlighted by the mass spectra of the product.

Example 1: Synthesis of p-dodecyl calix[4,5,6,7,8]arene

The following are loaded, in an inert nitrogen atmosphere, into the reactor previously described:

300.0 g (1.143 mol) of branched p-dodecylphenol (tetrapropenylphenol), 120.3 g (1.486 mol) of 37.1% formaldehyde (Sigma Aldrich formaldehyde 37.1% wt/wt in water and methanol as a stabilizer), 6.4 g (0.080 mol) of a 50% wt/wt NaOH solution in water and 0.05 g of DOW FS 1250-10000 antifoam.

The Dean Stark is excluded by closing the valve of the "vapor line" and the cooling fluid of the condensers is kept at the temperature of 10° C., then the stirring begins (600 rpm) and the mixture is heated with oil in the reactor jacket to the temperature of 120° C. so that the temperature of the reaction mixture increases reaching 95° C. It is left stirred in such operating conditions for 3 hours.

Subsequently, the valve of the "vapor line" is slowly opened, placing the reactor in communication with the Dean Stark condenser and then the oil in the reactor jacket is heated from 105° C. to 156° C. in about 2 hours so as to reach in such time a temperature of 112° C. of the reaction mixture. In this step the stabilizing methanol and most of the formaldehyde dilution water are removed by distillation. To the reaction mixture, at the temperature of about 112° C., a first aliquot of xylene equal to 90 g is added. The connection valve of the reactor with the "vapor line" is closed, then the temperature of the reaction mixture is brought to 112° C. and it is kept stirred under such conditions for 3 hours. The sample of the reaction mixture is collected and subjected to HPLC analysis from which a concentration of tetrapropenylphenol on the dry product (without xylene) of 1.45% w/w is found. In a nitrogen atmosphere the reaction mixture is left to cool to the temperature of 90° C. and then 900 g of xylene are added. The valve that places the reactor in communication with the "vapor line" is opened and the mixture is heated with oil in the reactor jacket gradually to a temperature of 160° C., collecting the water removed by distillation in the Dean Stark condenser. After removing the water, a temperature of the reaction mixture of 141° C. is reached. Then the reaction mixture is left in such operating conditions for 2 hours. The sample of the reaction mixture is collected and subjected to HPLC analysis from which a concentration of tetrapropenylphenol on the dry product (without xylene) of 0.51% wt/wt is found.

The total quantity of distillate collected in the Dean Stark condenser from the start of the reaction is 103.9 g. The reaction mixture is left to cool to the temperature of 95° C. and then, maintaining the mixture stirred, 450 g of demineralized water are added, it is left at such temperature for 30 minutes, then the stirring is interrupted and the two phases are left to separate for about 30 minutes. The aqueous phase that is clear and well separated is unloaded from the bottom of the reactor.

The mixture remaining in the reactor is heated with oil in the reactor jacket to the temperature of 160° C. so as to be able to remove the water present in the mixture through the Dean Stark condenser and reach a temperature of the mixture of 141° C. The mixture is left stirred under such operating conditions for 1 hour so as to remove all the residual water. A sample of mixture is taken and the concentration of the product in the xylene is determined through thermal scale, then 723.1 g of xylene are removed by distillation and 576.5 g of product at 53.7% wt/wt in xylene are obtained.

A sample of the reaction mixture is collected and subjected to HPLC analysis from which a concentration of tetrapropenylphenol on the dry product (without xylene) of 0.49% wt/wt is found.

$^{1}$H-NMR analysis is also performed on the sample of reaction mixture, from which a value of 2.1% mol/mol is obtained as the sum of the molar concentration percentages of tetrapropenylphenol and linear oligomers on the dry product (without xylene). Considering an average molecular weight of the linear oligomers of 811.33 g/mol, the concentration of linear oligomers is therefore 4.45% wt/wt on the dry product. The concentration of tetrapropenylphenol on the 53.7% wt/wt product solution in xylene is 0.26% wt/wt, less than 0.3% wt/wt and therefore such as not to classify said mixture as a reproductive toxicant.

The product yield, consisting of 95.06% of p-dodecyl calix[4,5,6,7,8]arene, 0.49% wt/wt of tetrapropenylphenol and 4.45% wt/wt of linear oligomers is equal to 98.9%.

The p-dodecyl calix[4,5,6,7,8]arene yield is 94%.

The presence of various calixarene structures was determined through $^{1}$HNMR, $^{13}$CNMR analysis and ESI mass spectrometry on the product after removing all the solvent. From said analyses it emerges that the product with calixarene structures is a mixture of cyclic products with 4, 5, 6, 7 and 8 units.

Comparative Example 2: Synthesis of p-dodecyl calix[4,5,6,7,8]arene

The following are loaded, in an inert nitrogen atmosphere, into the reactor previously described:

300.5 g (1.143 mol) of branched p-dodecylphenol (tetrapropenylphenol), 114.7 g (1.418 mol) of 37.1% formaldehyde (Sigma Aldrich formaldehyde 37.1% wt/wt in water and methanol as a stabilizer), 5.2 g (0.065 mol) of a 50% wt/wt NaOH solution in water. With the "Vapor line" valve open which connects the reactor with the Dean Stark condenser, the reaction mixture is stirred and heated slowly in an inert atmosphere so that in about 2 hours it reaches the temperature of 120° C. In this step the stabilizing methanol and the condensation and formaldehyde dilution water are removed by distillation. The reaction mixture is left in such operating conditions for 2 hours. The water formed is collected in the "Dean Stark" condenser. Then, in a nitrogen atmosphere the reaction mixture is left to cool to the temperature of 90° C. and then 1050 g of xylene are added. The mixture is heated and stirred with oil in the reactor jacket the temperature of which is brought to 160° C. collecting the water removed by distillation in the Dean Stark condenser. The reaction mixture is then left in such operating conditions for 4 hours.

The reaction mixture is left to cool to the temperature of 50° C. and then the organic mixture stirred with water is washed by adding 450 g of demineralized water. It is left at such temperature for 30 minutes, then stirring is interrupted and the two phases are left to separate for about 2 hours. The aqueous phase that is not completely clear is unloaded from the bottom of the reactor.

The mixture still in the reactor is heated with oil in the reactor jacket to the temperature of 160° C. so as to be able to remove the water present in the mixture by means of the Dean Stark condenser. Then 707.4 g of xylene are removed by distillation and 576.5 g of 52.1% wt/wt product in xylene are obtained.

The sample of the reaction mixture is collected and subjected to HPLC analysis from which a concentration of tetrapropenylphenol on the dry product (without xylene) of 4.1% wt/wt is found.

$^1$H-NMR analysis is also performed on the sample of reaction mixture, from which a value of 10.8% mol/mol is obtained as the sum of the molar concentrations of tetrapropenylphenol and linear oligomers on the dry product (without xylene). Considering an average molecular weight of the linear oligomers of 811.33 g/mol, the concentration of linear oligomers is 16.0% wt/wt on the dry product. The concentration of tetrapropenylphenol on the 52.1% wt/wt product solution in xylene is 2.05% wt/wt, greater than 0.3% wt/wt and therefore such as to classify said mixture as a reproductive toxicant.

The product yield, consisting of 79.9% wt/wt of p-dodecyl calix[4,5,6,7,8]arene, 4.1% wt/wt of tetrapropenylphenol and 16% wt/wt of linear oligomers is equal to 98.5%.

The p-dodecyl calix[4,5,6,7,8]arene yield is 78.7%.

Examples 3-5: Preparation of Overbased Detergents from Calixarenes of Formula (I) and Stearic Acid Examples 3-5 relate to the preparation of detergent compositions comprising overbased calcium salts of calixarenes of general formula (I) and overbased calcium salts of stearic acid. In particular, example 3 relates to the preparation of detergent compositions with the improved process according to the present disclosure, which uses as calixarene the one of example 1, obtained with the process described and claimed in the present patent application. Said process for preparing the detergent compositions, as well as allowing products to be obtained with a low content of TPP and its corresponding calcium salt, also enables detergents to be obtained with high alkalinity and viscosity and turbidity values such as to make them easy to process on an industrial scale. Comparative example 4, which is not part of the disclosure, instead relates to a process that uses the calixarene of comparative example 2 and therefore provides a product which as well as being reproductive toxic also has non-optimal alkalinity and turbidity characteristics.

Comparative example 5 uses the calixarene of the comparative example 2 and a process that does not envisage the addition of water prior to carbonation. In such example, a product is generated which, as well as being reproductive toxic, also has non-optimal alkalinity and turbidity characteristics and a viscosity value such as to make the process not suitable for industrialization.

The following analytical tests were performed on the products obtained in examples 3-5:

- The TBN (total basic number), expressed in mg KOH/g, which was determined as described in the ASTM D 2896 method. The TBN expresses the total alkalinity of the detergent composition.
- The free alkalinity of the detergent composition, expressed in mg KOH/g, which was determined as described in the ISO 4314 method. The contribution to the free alkalinity of the detergent composition was provided by the free calcium hydroxide.
- The turbidity, expressed in nephelometric turbidity units (NTU), which was determined with the HACH 2100 AN turbidimeter on the solution of the 5% wt/wt detergent composition in base oil SN 150.
- The calcium content, which was determined through inductively coupled plasma atomic emission spectroscopy (ICP-AES), as described in method ASTM D 4951.
- The kinematic viscosity at 100° C., which was determined according to method ASTM D 445.

In the examples 3-5 of preparation of the detergent compositions, the equipment used is comprised of an RC-1 Mettler calorimeter equipped with a 5-neck jacketed glass reactor, with a volume of 2 litres, thermostated by circulation in the jacket of a fluid coming from a thermostatic bath internal to the instrument. The reactor is provided with: mechanical blade stirrer; a coil condenser cooled to the temperature of 10° C. with thermo-cryostat; a Dean Stark condenser, cooled to the temperature of 10° C. with thermo-cryostat, connected to the nitrogen line and provided with a container cooled to the temperature of 10° C. for collecting the distillate; discharge with bottom provided with a teflon tap; thermocouple for measuring the temperature; tubular glass float with porous baffle at the end for the bubbling of the carbon dioxide in the reaction mass. The supply of the carbon dioxide is performed by cylinders, provided with a pressure reducer and connected by means of a stainless steel line of diameter ¼" to a mass flow meter which in turn is connected to the glass tubular float by means of rubber hoses.

The mass flow meter enables the carbon dioxide flow to be regulated and the quantity of carbon dioxide supplied to be determined.

The entire system is controlled by a computer, which enables the reactor to be automated by setting the desired heating and cooling programs.

Example 3: Preparation of the Overbased Detergent with TBN of about 400 mgKOH/g, Starting from the Calixarene of Example 1

The following are loaded, in a nitrogen atmosphere, into the reactor previously described: 212.56 grams of the product of example 1 at 53.7% wt/wt in xylene (p-dodecyl calix[4,5,6,7,8]arene: MW=274.4 g/mol per repetitive unit, 0.395 moles; tetrapropenylphenol: MW=262.4, 0.00222 moles; linear oligomers: MW=811.3 g/mol, 0.00626 moles); 114.14 grams of stearic acid (0.401 moles); 238.81 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 98.4 grams of xylene are collected. The vacuum is removed, the nitrogen atmosphere is restored, it is cooled to the temperature of about 80° C. and 733.45 grams of 2-ethylhexanol and 72.90 grams of ethylene glycol are added. Subsequently, 199.84 grams of calcium hydroxide of purity 96% wt/wt (2.589 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and 72.90 grams of ethylene glycol and 9 grams of water are loaded at the temperature of 130° C.

Subsequently, 85.50 grams of carbon dioxide (1.943 moles) are added at the temperature of 130° C. in 180 minutes, stirring the mixture at 750 rpm.

The exact dose of carbon dioxide and water is very important for the success of the process and for obtaining a product with the desired stability and viscosity characteristics. The carbonation reaction is exothermal and therefore the temperature of the mixture must be controlled by intervening on the temperature of the oil in the jacket and on the carbon dioxide flow rate.

After the addition of the carbon dioxide the stirring is reduced to 500 rpm and the mixture is left at the temperature of 130° C. for 30 minutes. The mixture is cooled, maintained stirred, with oil in the jacket at the temperature of 50° C. The stripping of the solvents then begins, gradually reducing the pressure until reaching about 30 mbar and raising the temperature of the oil in the jacket from 50° C. to 100° C. in 70 minutes. In these conditions, the water is removed from the product. Then the stripping of the solvents continues at the pressure of about 30 mmHg, heating the oil in the jacket from 100° C. to 200° C. in about 90 minutes. Once the internal temperature of 190° C. is reached, the pressure is reduced to about 10 mbar and it is left in such conditions for about 60 minutes. During this step the solvent is removed by flash distillation, condensed and collected in a refrigerated container connected to the Dean Stark condenser.

Once the temperature of the mixture has reached 190° C. the pressure is reduced further below 10 mbar and it is left in such conditions for 60 minutes to remove most of the residual solvent from the product. Then the reaction mixture is cooled to 80° C., the vacuum is removed and the nitrogen atmosphere is restored. The purification of the product from the sediments is performed by centrifugation of the raw product with a solvent. For that purpose, 700 grams of toluene are added to the raw product weighing 708 grams in the reactor. The mixture is left under stirring for about 15 minutes, then it is unloaded and subjected to centrifugation using a laboratory centrifuge operating at room temperature at a speed of 2000 rpm for 20 minutes.

The supernatant contained in the centrifugation test tubes is transferred into the reactor previously described, where the toluene is removed by flash distillation. For that purpose, in nitrogen atmosphere and stirring the mixture (500 rpm), the oil is heated in the reactor jacket using a thermostat in order to reach a temperature of 180° C. in about 1 hour. Then the vacuum is applied, gradually reducing the pressure until reaching a pressure below 10 mbar and the mixture is maintained in such conditions for about 1 hour to completely remove the centrifugation solvent. Subsequently, the oil in the reactor jacket is cooled to 90° C. and then the product is unloaded.

The quantity of product obtained is 665.5 grams with a yield of 95%.

It is considered that the TPP introduced with calixarene, the calixarene and the linear oligomers are salified to the corresponding calcium salts for a percentage equal to 78%.

Such salification percentage was determined in the operating conditions of the preparation of the detergent by the quantity of water generated during salification.

With this hypothesis the percentage of TPP and of its calcium salt can be determined in the detergent composition:

TPP calcium salt content: 0.073% wt/wt

TPP content: 0.018% wt/wt

The sum of the percentages of TPP and the calcium salt of the TPP is equal to 0.091% wt/wt, a value less than 0.3% and therefore such as to make said detergent composition not reproductive toxic.

The product thus obtained has the following characteristics:

Calcium content: 14.49% wt/wt

Viscosity at 100° C.: 119.32 cSt

TBN: 405.5 mg KOH/g

Free alkalinity: 43.2 mg KOH/g

Turbidity (5% solution in SN 150): 9 NTU(nephelometric units).

On the basis of the result obtained, the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=97.7%

Calcium hydroxide carbonation=87.6%

Calcium stearate=17.5% wt/wt

Calcium salts of calixarene, TPP and linear oligomers=13.7% wt/wt

Total soap content=31.2% wt/wt.

Comparative Example 4: Preparation of the Overbased Detergent with TBN of about 400 mgKOH/g Using the Calixarene of Example 2 and Stearic Acid The following are loaded, in a nitrogen atmosphere, into the reactor previously described: 219.11 grams of the product of example 2 at 52.1% wt/wt in xylene (p-dodecyl calix[4,5,6,7,8]arene: MW=274.4 g/mol per repetitive unit, 0.332 moles; tetrapropenylphenol: MW=262.4, 0.0178 moles; linear oligomers: MW=811.3 g/mol, 0.0225 moles);

114.15 grams of stearic acid (0.401 moles); 238.78 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 104.9 grams of xylene are collected. The vacuum is removed, the nitrogen atmosphere is restored, it is cooled to the temperature of about 80° C. and 733.4 grams of 2-ethylhexanol and 72.90 grams of ethylene glycol are added. Subsequently, 199.85 grams of calcium hydroxide of purity 96% wt/wt (2.589 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and 72.90 grams of ethylene glycol and 9 grams of water are loaded at the temperature of 130° C.

Subsequently, 85.52 grams of carbon dioxide (1.944 moles) are added at the temperature of 130° C. in 180 minutes, stirring the mixture at 750 rpm.

After the addition of the carbon dioxide the stirring is reduced to 500 rpm and the mixture is left at the temperature of 130° C. for 30 minutes. The mixture is cooled, kept stirred, with oil in the jacket at the temperature of 50° C. Then the stripping of the solvents continues operating with the same process already described in example 3. Then the reaction mixture is cooled to 80° C., the vacuum is removed and the nitrogen atmosphere is restored. The purification of the product from the sediments is performed by centrifugation of the raw product weighing 708 grams, after dilution with 700 g of toluene as already described in example 3.

The supernatant contained in the centrifugation test tubes is transferred into the reactor previously described, where the toluene is removed by flash distillation, as already described in example 3.

The quantity of product obtained is 658.5 grams with a yield of 94%.

It is considered that the TPP introduced with calixarene, the calixarene and the linear oligomers are salified to the corresponding calcium salts for a percentage equal to 78%. Such salification percentage was determined in the operating conditions of the preparation of the detergent by the quantity of water generated during salification.

With this hypothesis the percentage of TPP and of its calcium salt can be determined in the detergent composition:

TPP Calcium salt content: 0.596% wt/wt

TPP content: 0.15% wt/wt

The sum of the percentages of TPP and the calcium salt of the TPP is equal to 0.746% wt/wt, a value greater than 0.3% wt/wt and therefore such as to make said detergent composition reproductive toxic.

The product thus obtained has the following characteristics:

Calcium content: 14.28% wt/wt

Viscosity at 100° C.: 104.95 cSt

TBN: 399.8 mg KOH/g

Free alkalinity: 37.9 mg KOH/g

Turbidity (5% solution in SN 150): 19 NTU (nephelometric units)

On the basis of the result obtained the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=96.3%

Calcium hydroxide carbonation 88.9%

Calcium stearate=17.80% wt/wt

Calcium salts of calixarene, TPP and linear oligomers=13.90% wt/wt

Total soap content=31.70% wt/wt

Such example provides a product which, as well as being considered reproductive toxic due to the high TPP content, also has a non-optimal turbidity value, higher with respect to that of example 3 and lower incorporation efficiency values of the calcium and TBN.

Comparative Example 5: Preparation of the Overbased Detergent with TBN of about 400 mgKOH/g Using the Calixarene of Example 2 and Stearic Acid, without the Addition of Water Prior to Carbonation The following are loaded, in a nitrogen atmosphere, into the reactor previously described: 219.26 grams of the product of example 2 at 52.1% wt/wt in xylene (p-dodecyl calix[4,5,6,7,8]arene: MW=274.4 g/mol per repetitive unit, 0.333 moles; tetrapropenylphenol: MW=262.4, 0.0178 moles; linear oligomers: MW=811.3 g/mol, 0.0225 moles); 114.24 grams of stearic acid (0.402 moles); 238.95 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 105 grams of xylene are collected. The vacuum is removed, the nitrogen atmosphere is restored, it is cooled to the temperature of about 80° C. and 734 grams of 2-ethylhexanol and 72.95 grams of ethylene glycol are added. Subsequently, 199.99 grams of calcium hydroxide of purity 96% wt/wt (2.591 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and 72.95 grams of ethylene glycol are loaded at the temperature of 130° C.

Subsequently, 85.58 grams of carbon dioxide (1.945 moles) are added at the temperature of 130° C. in 180 minutes, stirring the mixture at 750 rpm.

After the addition of the carbon dioxide the stirring is reduced to 500 rpm and the mixture is left at the temperature of 130° C. for 30 minutes. The mixture is cooled, kept stirred, with oil in the jacket at the temperature of 50° C. Then the stripping of the solvents continues operating with the same process already described in example 3. Then the reaction mixture is cooled to 80° C., the vacuum is removed and the nitrogen atmosphere is restored. The purification of the product from the sediments is performed by centrifugation of the raw product weighing 708 grams, after dilution with 700 g of toluene as already described in example 3.

The supernatant contained in the centrifugation test tubes is transferred into the reactor previously described, where the toluene is removed by flash distillation, as already described in example 3.

The quantity of product obtained is 654.3 grams with a yield of 93.4%.

It is considered that the TPP introduced with calixarene, the calixarene and the linear oligomers are salified to the corresponding calcium salts for a percentage equal to 78%. Such salification percentage was determined in the operating conditions of the preparation of the detergent by the quantity of water generated during salification.

With this hypothesis the percentage of TPP and of its calcium salt can be determined in the detergent composition:

TPP calcium salt content: 0.598% wt/wt

TPP content: 0.151% wt/wt

The sum of the percentages of TPP and the calcium salt of the TPP is equal to 0.749% wt/wt, a value greater than 0.3% wt/wt and therefore such as to make said detergent composition reproductive toxic.

The product thus obtained has the following characteristics:

Calcium content: 14.11% wt/wt

Viscosity at 100° C.: 1153.21 cSt

TBN: 395.0 mg KOH/g

Free alkalinity: 35.6 mg KOH/g

Turbidity (5% solution in SN 150): 18 NTU (nephelometric units).

On the basis of the result obtained the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=95.1%

Calcium hydroxide carbonation 89.4%

Calcium stearate=17.83% wt/wt

Calcium salts of calixarene, TPP and linear oligomers=13.94% wt/wt

Total soap content=31.77% wt/wt

Such example provides a product which, as well as being considered reproductive toxic, because of the high TPP content, has worse turbidity, calcium and TBN incorporation efficiency values than those of example 3 and a high level of viscosity which makes it difficult to process on an industrial scale. The high viscosity value is to be associated with the lack of addition of water prior to carbonation.

The addition of water is necessary in detergents with high alkalinity and the quantity to be added with the purpose of optimizing the viscosity of the product increases as the TBN of the detergent increases.

Examples 6-8: Preparation of Overbased Detergents from Calixarenes of Formula (I), Stearic Acid and Mono-Alkyl Benzenesulfonic Acid Examples 6-8 relate to the preparation of detergent compositions comprising overbased calcium salts of calixarenes of general formula (I), the overbased calcium salt of stearic acid and a overbased calcium salt of a mono-alkyl benzenesulfonic acid. In particular, examples 6 and 7 relate to the preparation of detergent compositions with the improved process according to the present disclosure, which uses as calixarene the one of example 1, obtained with the process described and claimed in the present patent application. Said process for preparing the detergent compositions, as well as allowing products to be obtained with a low content of TPP and its corresponding calcium salt, also enables detergents to be obtained with very high alkalinity and viscosity and turbidity values such as to make them easy to process on an industrial scale. Comparative example 8, which is not part of the disclosure, uses the calixarene of comparative example 2 and therefore provides a product which as well as being reproductive toxic also has non-optimal alkalinity and turbidity characteristics.

On the products obtained in examples 6-8, the analytical determinations already previously described in examples 3-5 were performed.

Example 6: Preparation of the Overbased Detergent with TBN of about 370-380 mgKOH/g, Starting from the Calixarene of Example 1, Stearic Acid and Mono-Alkyl Benzenesulfonic Acid The following are loaded, in a nitrogen atmosphere, into the reactor previously described: 166.91 grams of the product of example 1 at 53.7% wt/wt in xylene (p-dodecyl calix[4,5,6,7,8]arene: MW=274.4 g/mol per repetitive unit, 0.310 moles; tetrapropenylphenol: MW=262.4, 0.00174 moles; linear oligomers: MW=811.3 g/mol, 0.00492 moles); 89.63 grams of stearic acid (0.315 moles); 247.96 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 77.3 grams of xylene are collected. The vacuum is removed, the nitrogen atmosphere is restored, it is cooled to the temperature of about 80° C. and 733.87 grams of 2-ethylhexanol and 73.98 grams of ethylene glycol are added. Subsequently, 189.27 grams of calcium hydroxide of purity 96% wt/wt (2.452 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and at the temperature of 130° C., through dropping funnel, 52.41 grams of Huntsman HSA 118 mono-alkyl benzenesulfonic acid characterized by an active part (purity) of 85.5% wt/wt (Mw=475 g/mol, 0.0943 mol), 73.98 grams of ethylene glycol and 8 grams of water are loaded.

Subsequently, 80.70 grams of carbon dioxide (1.834 moles) are added at the temperature of 130° C. in 180 minutes, stirring the mixture at 750 rpm.

The exact dose of carbon dioxide and water is very important for the success of the process and for obtaining a product with the desired stability and viscosity characteristics.

The carbonation reaction is exothermal and therefore the temperature of the mixture must be controlled by intervening on the temperature of the oil in the jacket and on carbon dioxide flow rate.

After the addition of the carbon dioxide the stirring is reduced to 500 rpm and the mixture is left at the temperature of 130° C. for 30 minutes. The mixture is cooled, maintained stirred, with oil in the jacket at the temperature of 50° C.

The stripping of the solvents then begins, gradually reducing the pressure until reaching about 30 mbar and raising the temperature of the oil in the jacket from 50° C. to 90-100° C. in 70 minutes. In these conditions, the water is removed from the product. Then the stripping of the solvents continues at the pressure of about 30 mmHg, heating the oil in the jacket from 100° C. to 200° C. in about 90 minutes. Once the internal temperature of 190° C. is reached, the pressure is reduced to about 10 mbar and it is left in such conditions for about 60 minutes. During this step the solvent is removed by flash distillation and condensed and collected in a refrigerated container connected to the Dean Stark condenser.

Once the temperature of the mixture has reached 190° C. the pressure is reduced further below 10 mbar and it is left in such conditions for 60 minutes to remove most of the residual solvent from the product. Then the reaction mixture is cooled to 80° C., the vacuum is removed and the nitrogen atmosphere is restored. The purification of the product from the sediments is performed by centrifugation of the raw product with a solvent. For that purpose, 700 grams of toluene are added to the raw product weighing 708 grams in the reactor. The mixture is left stirred for about 15 minutes, then it is unloaded and subjected to centrifugation using a laboratory centrifuge operating at room temperature at a speed of 2000 rpm for 20 minutes.

The supernatant contained in the centrifugation test tubes is transferred into the reactor previously described, where the toluene is removed by flash distillation. For that purpose, in nitrogen atmosphere and stirring the mixture (500 rpm), the oil is heated in the reactor jacket using a thermostat in order to reach a temperature of 180° C. in about 1 hour. Then the vacuum is applied, gradually reducing the pressure until reaching a pressure below 10 mbar and the mixture is maintained in such conditions for about 1 hour to completely remove the centrifugation solvent. Subsequently, the oil is cooled to 90° C. in the jacket and then the product is unloaded.

The quantity of product obtained is 665.5 grams with a yield of 95%.

It is considered that the TPP introduced with calixarene, the calixarene and the linear oligomers are salified to the corresponding calcium salts for a percentage equal to 78%.

Such salification percentage was determined in the operating conditions of the preparation of the detergent by the quantity of water generated during salification.

With this hypothesis the percentage of TPP and of its calcium salt can be determined in the detergent composition:

TPP calcium salt content: 0.057% wt/wt

TPP content: 0.014% wt/wt

The sum of the percentages of TPP and the calcium salt of the TPP is equal to 0.071% wt/wt, a value less than 0.3% wt/wt and therefore such as to make said detergent composition not reproductive toxic.

The product thus obtained has the following characteristics:

Calcium content: 13.97% wt/wt

Viscosity at 100° C.: 123.15 cSt

TBN: 383.0 mg KOH/g

Free alkalinity: 41.6 mg KOH/g

Turbidity (5% solution in SN 150): 8 NTU (nephelometric units)

On the basis of the result obtained the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=99.5%

Calcium hydroxide carbonation 87.7%

Calcium stearate=13.7% wt/wt

Calcium salts of calixarene, TPP and linear oligomers=10.7% wt/wt

Calcium salt of mono-alkyl benzenesulfonic acid HSA 118=6.7% wt/wt

Total soap content=31.1% wt/wt.

Example 7: Preparation of the Overbased Detergent with TBN of about 500 mgKOH/g, Starting from the Calixarene of Example 1, Stearic Acid and Mono-Alkyl Benzenesulfonic Acid The following are loaded, in a nitrogen atmosphere, into the reactor previously described: 166.93 grams of the product of example 1 at 53.7% wt/wt in xylene (p-dodecyl calix[4,5,6,7,8]arene: MW=274.4 g/mol per repetitive unit, 0.310 moles; tetrapropenylphenol: MW=262.4, 0.00174 moles; linear oligomers: MW=811.3 g/mol, 0.00492 moles); 89.64 grams of stearic acid (0.315 moles); 163.68 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 77.2 grams of xylene are collected. The vacuum is removed, the nitrogen atmosphere is restored, it is cooled to the temperature of about 80° C. and 743.9 grams of 2-ethylhexanol and 74 grams of ethylene glycol are added.

Subsequently, 254.33 grams of calcium hydroxide of purity 96% wt/wt (3.295 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and at the temperature of 130° C., through dropping funnel, 52.42 grams of Huntsman HSA 118 mono-alkyl benzenesulfonic acid characterized by an active part (purity) of 85.5% wt/wt (Mw=475 g/mol, 0.0944 mol), 74 grams of ethylene glycol and 15 grams of water are loaded.

Subsequently, 117.78 grams of carbon dioxide (2.677 moles) are added at the temperature of 130° C. in 180 minutes, stirring the mixture at 750 rpm.

After the addition of the carbon dioxide the stirring is reduced to 500 rpm and the mixture is left at the temperature of 130° C. for 30 minutes. The mixture is cooled, kept stirred, with oil in the jacket at the temperature of 50° C. Then the stripping of the solvents begins, using the same process already illustrated in example 6.

The purification of the product from the sediments is performed by centrifugation of the raw product, weighing 708 grams, following dilution with 700 grams of toluene, using the procedure already illustrated in example 6.

The supernatant contained in the centrifugation test tubes is transferred into the reactor previously described, where the toluene is removed by flash distillation using the procedure already illustrated in example 6.

The quantity of product obtained is 658.1 grams with a yield of 94%.

It is considered that the TPP introduced with calixarene, the calixarene and the linear oligomers are salified to the corresponding calcium salts for a percentage equal to 78%.

Such salification percentage was determined in the operating conditions of the preparation of the detergent by the quantity of water generated during salification.

With this hypothesis the percentage of TPP and of its calcium salt can be determined in the detergent composition:

TPP calcium salt content: 0.059% wt/wt

TPP content: 0.015% wt/wt

The sum of the percentages of TPP and the calcium salt of the TPP is equal to 0.074% wt/wt, a value less than 0.3% and therefore such as to make said detergent composition not reproductive toxic.

The product thus obtained has the following characteristics:

Calcium content: 18.28% wt/wt

Viscosity at 100° C.: 412.53 cSt

TBN: 503.5 mg KOH/g

Free alkalinity: 45.4 mg KOH/g

Turbidity (5% solution in SN 150): 10 NTU (nephelometric units)

On the basis of the result obtained the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=96.9%

Calcium hydroxide carbonation=90.0%

Calcium stearate=14.0% wt/wt

Calcium salts of calixarene, TPP and linear oligomers=11.0% wt/wt

Calcium salt of mono-alkyl benzenesulfonic acid HSA 118=6.8% wt/wt

Total soap content=31.8% wt/wt.

Example 8: Preparation of the Overbased Detergent with TBN of about 370-380 mgKOH/g, Starting from the Calixarene of Example 2, Stearic Acid and Mono-Alkyl Benzenesulfonic Acid The following are loaded, in a nitrogen atmosphere, into the reactor previously described: 172.04 grams of the product of example 2 at 52.1% wt/wt in xylene (p-dodecyl calix[4,5,6,7,8]arene: MW=274.4 g/mol per repetitive unit, 0.261 moles; tetrapropenylphenol: MW=262.4, 0.0140 moles; linear oligomers: MW=811.3 g/mol, 0.0177 moles); 89.63 grams of stearic acid (0.315 moles); 247.94 grams of SN 150 base oil and 0.14 grams of DOW FS 1250-10000 antifoam.

The nitrogen is excluded and the pressure is reduced to about 20 mbar. Then the mixture is gradually heated under stirring (500 rpm) until reaching a temperature of the oil in the reactor jacket of 130° C. and the xylene is removed by flash distillation. 82.4 grams of xylene are collected. The vacuum is removed, the nitrogen atmosphere is restored, it is cooled to the temperature of about 80° C. and 743.8 grams of 2-ethylhexanol and 74 grams of ethylene glycol are added.

Subsequently, 189.27 grams of calcium hydroxide of purity 96% wt/wt (2.452 moles) are added to the stirred mixture at the temperature of about 60° C., through a loading funnel. The nitrogen is excluded and the vacuum is applied reducing the pressure gradually until reaching 70 mbar.

It is left in such operating conditions for 60 minutes, during which water and 2-ethylhexanol are removed by distillation, and collected in the Dean Stark condenser, where the water, which also contains small quantities of ethylene glycol, is separated from 2-ethylhexanol.

The vacuum is removed, the nitrogen atmosphere is restored and at the temperature of 130° C., through dropping funnel, 52.42 grams of Huntsman HSA 118 mono-alkyl benzenesulfonic acid characterized by an active part (purity) of 85.5% wt/wt (Mw=475 g/mol, 0.0944 mol), 74 grams of ethylene glycol and 8 grams of water are loaded.

Subsequently, 80.70 grams of carbon dioxide (1.834 moles) are added at the temperature of 130° C. in 180 minutes, stirring the mixture at 750 rpm.

After the addition of the carbon dioxide the stirring is reduced to 500 rpm and the mixture is left at the temperature of 130° C. for 30 minutes. The mixture is cooled, kept stirred, with oil in the jacket at the temperature of 50° C. Then the stripping of the solvents begins, using the same process already illustrated in example 6.

The purification of the product from the sediments is performed by centrifugation of the raw product, weighing 708 grams, following dilution with 700 grams of toluene, using the procedure already illustrated in example 6.

The supernatant contained in the centrifugation test tubes is transferred into the reactor previously described, where the toluene is removed by flash distillation using the procedure already illustrated in example 6.

The quantity of product obtained is 654.1 grams with a yield of 93.4%.

It is considered that the TPP introduced with calixarene, the calixarene and the linear oligomers are salified to the corresponding calcium salts for a percentage equal to 78%.

Such salification percentage was determined in the operating conditions of the preparation of the detergent by the quantity of water generated during salification.

With this hypothesis the percentage of TPP and of its calcium salt can be determined in the detergent composition:

TPP Calcium salt content: 0.467% wt/wt

TPP content: 0.118% wt/wt

The sum of the percentages of TPP and the calcium salt of the TPP is equal to 0.585% wt/wt, a value greater than 0.3% wt/wt and therefore such as to make said detergent composition reproductive toxic.

The product thus obtained has the following characteristics:

Calcium content: 13.51% wt/wt

Viscosity at 100° C.: 125.04 cSt

TBN: 370.0 mg KOH/g

Free alkalinity: 40.9 mg KOH/g

Turbidity (5% solution in SN 150): 16 NTU (nephelometric units)

On the basis of the result obtained the incorporation efficiency of the calcium in the detergent composition can be calculated, expressed as a percentage ratio of the calcium content in the finished product and the theoretic calcium content. Furthermore, considering that the free alkalinity corresponds to the free calcium hydroxide content, the stearic acid is completely salified by the calcium hydroxide and the calixarene, the TPP and the linear oligomers are partially salified (78%), the carbonation percentage of the excess calcium hydroxide with respect to the salification reaction, the calcium stearate content, the calcium salt content of the calixarene product and the total content of organic calcium salts (total soap) can be calculated.

Calcium incorporation efficiency=96.2%

Calcium hydroxide carbonation 87.4%

Calcium stearate=13.9% wt/wt

Calcium salts of calixarene, TPP and linear oligomers=10.9% wt/wt

Calcium salt of mono-alkyl benzenesulfonic acid HSA 118=6.8% wt/wt

Total soap content=31.6% wt/wt

Such example provides a product which, as well as being considered reproductive toxic due to the high TPP content, also has a non-optimal turbidity value, higher with respect to that of example 6 and lower incorporation efficiency values of the calcium and TBN.

The invention claimed is:

1. A mixture of compounds that comprises:

calixarenes not containing sulphur and soluble in lubricant base oil, having the following general formula (I):

(I)

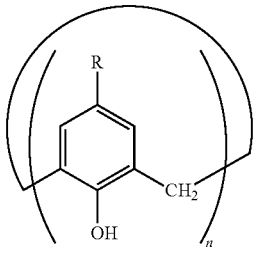

wherein:

a. R is selected from a linear or branched alkyl having a number of carbon atoms ranging from 4 to 40;

b. n is the number of units of the calixarene cycle and is comprised in the range between 4 and 16;

a concentration of unreacted alkylphenol, expressed as a percentage by weight of the alkylphenol on the mixture of compounds, less than or equal to 2.0%, such alkylphenol having the general formula (II)

(II)

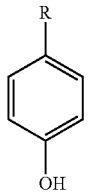

wherein R is as described for formula (I);

a concentration of linear oligomers, expressed as a percentage by weight of linear oligomers on the mixture of compounds, less than or equal to 20%; said linear oligomers having the general formula (III)

(III)

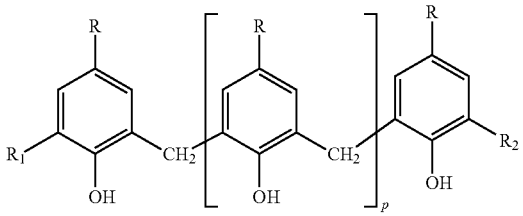

wherein R is as defined in formula (I), $R_1$ and $R_2$ hydrogen, or the hydroxymethylene group (—$CH_2OH$), and p is comprised between 0 and 6.

2. Mixture of compounds for detergent compositions according to claim 1 wherein the concentration of unreacted alkylphenol is less than 1.0% by weight with respect to the mixture.

3. Mixture of compounds for detergent compositions according to claim 2 wherein the concentration of unreacted alkylphenol is less than 0.5% by weight with respect to the mixture.

4. Mixture of compounds for detergent compositions according to claim 1 wherein the concentration of linear oligomers is less than 15% by weight with respect to the mixture.

5. Mixture of compounds for detergent compositions according to claim 4 wherein the concentration of linear oligomers is less than 5% by weight with respect to the mixture.

6. Process for preparing a mixture of compounds for detergent compositions according claim 1, which comprises the following steps:

performing a condensation reaction between the alkylphenol and formaldehyde in aqueous solution at a certain temperature comprised between 70° C. and 125° C., at an absolute pressure that ranges from 1 bar to 5 bar, and for a reaction time that ranges from 1 hour to 5 hours; for forming a first intermediate product (INTERMEDIATE 1), in the presence of a basic catalyst, in the absence of solvent and without removal of the water present in the aqueous solution of formaldehyde and which is formed during the condensation reaction; subsequently distilling said first intermediate product (INTERMEDIATE 1), increasing the temperature up to a maximum of 130° C. included and thus partially removing the water deriving from the aqueous formaldehyde solution and from the condensation reaction, to form a second intermediate product (INTERMEDIATE 2); subsequently adding to the second intermediate product a solvent and completing the condensation reaction without further removal of the water, forming a third intermediate product (INTERMEDIATE 3) which contains linear oligomers having formula (III), wherein R is as described for formula (I), $R_1$ and $R_2$ are hydrogen, or the hydroxymethylene group (—$CH_2OH$), and p is comprised between 0 and 6; subsequently adding a remaining portion of the solvent to said third intermediate product and completely removing the water present by distillation, forming by cyclization of the linear oligomers a final mixture that contains the mixture of compounds for detergent compositions, solvent and sediments; subsequently separating said sediments from the mixture containing compounds for detergent compositions; subsequently distilling said mixture of additives for detergent compositions by removing the residual water and partially or totally the solvent.

7. Process for preparing a mixture of compounds for detergent compositions according to claim 6, wherein the condensation reaction between alkylphenol and formaldehyde in aqueous solution is carried out at a temperature ranging from 80° C. to 110° C.

8. Process for preparing a mixture of compounds for detergent compositions according to claim 7, wherein the condensation reaction between alkylphenol and formaldehyde in aqueous solution is carried out at a pressure comprised between 1 bar and 2 bar absolute.

9. Process for preparing a mixture of compounds for detergent compositions according to claim 6, wherein the formaldehyde is used in an amount, expressed as a ratio between the formaldehyde equivalents and the alkylphenol equivalents ranging between 1 and 2.

10. Process for preparing a mixture of compounds for detergent compositions according to claim 6, wherein the basic catalyst is an alkali or alkaline-earth metal hydroxide.

11. Process for preparing a mixture of compounds for detergent compositions according to claim 10 wherein the basic catalyst is an alkaline metal hydroxide selected from the group consisting of sodium hydroxide and potassium hydroxide.

12. Process for preparing a mixture of compounds for detergent compositions according to claim 6, wherein the alkylphenol compounds are those in which the alkyl substituent is present in a para position to the phenol hydroxyl.

13. Process for preparing a mixture of compounds for detergent compositions according to claim 12 wherein the alkylphenols are selected from the group consisting of para-tert-octylphenol, para-alkylphenols whose alkyl group derives from polypropylene, polyisobutene and poly-1-butene, and mixtures thereof.

14. Process for preparing a mixture of compounds for detergent compositions according to claim 6, wherein the amount of water removed by distillation from the first intermediate product, expressed in weight percentage with respect to the weight of the water initially present, is comprised between 20% and 99%.

15. Process for preparing a mixture of compounds for detergent compositions according to claim 6, in which the condensation reaction is continued, without removing the water, maintaining the second intermediate product at a temperature comprised between 100° C. and 140° C.

16. Process for preparing a mixture of compounds for detergent compositions according to claim 6, wherein during the completion of the condensation reaction the pressure is between 1 bar and 5 bar.

17. Process for preparing a mixture of compounds for detergent compositions according to claim 6, wherein the solvent is not miscible in water and has a boiling point greater than or equal to the maximum desired temperature in the condensation reaction between para-alkylphenol and formaldehyde.

18. Process for preparing a mixture of compounds for detergent compositions according to claim 17 wherein the solvent is selected from the group consisting of aromatic hydrocarbons with a number of carbon atoms comprised between 6 and 16, aliphatic or cycloaliphatic hydrocarbons having a number of carbon atoms comprised between 7 and 16, and alkyl, aryl-alkyl and aromatic ethers with a number of carbon atoms comprised between 8 and 16.

19. Detergent compositions, comprising:

overbased metal salts of calixarenes not containing sulphur and soluble in lubricant base oil having the following general formula (I):

(I)

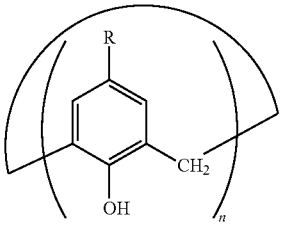

wherein:

a. R is selected from a linear or branched alkyl having a number of carbon atoms ranging from 4 to 40;

b. n is the number of units of the calixarene cycle and is comprised in the range between 4 and 16;

said detergent compositions having:

a content of overbased metallic salts of calixarenes of formula (I), expressed as a percentage by weight with respect to the detergent composition, ranging from 10% to 90%;

an alkylphenol content of formula (II) and its corresponding metal salt, expressed as the sum of the weight percentages of the alkylphenol and its metal salt with respect to the weight of the detergent composition, less than or equal to 0.29%, wherein the alkylphenol of formula (II) is the following:

(II)

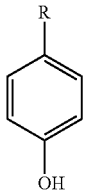

wherein R is as described for formula (I);

a content of overbased metal salts of linear oligomers of formula (III), expressed as a percentage by weight with respect to the weight of the detergent composition, less than or equal to 15%, wherein such linear oligomers of formula (III) are the following:

(III)

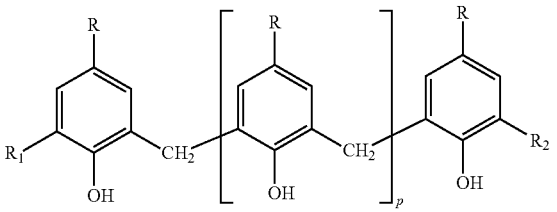

wherein R is as defined in formula (I), $R_1$ and $R_1$ are hydrogen, or the hydroxymethylene group (—$CH_2OH$), and p is comprised between 0 and 6;

a Total Base Number (TBN) value, expressed in mg KOH/g, between 120 and 550; and a kinematic viscosity value at 100° C. less than or equal to 600 $mm^2/s$.

20. Process for the preparation of detergent compositions according to claim 19 which comprises the following steps:

preparing a mixture of compounds according to the following substeps:

performing a condensation reaction between the alkylphenol and formaldehyde in aqueous solution at a certain temperature comprised between 70° C. and 125° C., at an absolute pressure that ranges from 1 bar to 5 bar, and for a reaction time that ranges from 1 hour to 5 hours; for forming a first intermediate product (INTERMEDIATE 1), in the presence of a basic catalyst, in the absence of solvent and without removal of the water present in the aqueous solution of the formaldehyde and which is formed during the condensation reaction; subsequently distilling said first intermediate product (INTERMEDIATE 1), increasing the temperature up to a maximum of 130° C. included and thus partially removing the water deriving from the aqueous formaldehyde solution and from the condensation reaction, to form a second intermediate product (INTERMEDIATE 2); subsequently adding to the second intermediate product a solvent and completing the condensation reaction without further removal of the water, forming a third intermediate product (INTERMEDIATE 3) which contains the linear oligomers having formula (III), wherein R is as described for formula (I), $R_1$ and $R_2$ are hydrogen, or the hydroxymethylene group (—$CH_2OH$), and p is comprised between 0 and 6; subsequently adding a remaining portion of the solvent to said third intermediate product and completely removing the water present by distillation, forming by cyclization of the linear oligomers a final mixture that contains the mixture of compounds for detergent compositions, solvent and sediments; subsequently separating said sediments from the mixture containing compounds for detergent compositions; and subsequently distilling said mixture of additives for detergent compositions by removing the residual water and partially or totally the solvent, reacting said mixture of compounds with an excess of metal base forming a first intermediate mixture (INTERMEDIATE MIX 1), and then adding a certain amount of water to the first intermediate mixture forming a second intermediate mixture (INTERMEDIATE MIX 2) and then, reacting said second intermediate mixture with carbon dioxide, according to a carbonation reaction which converts the unreacted metal base, forming the detergent composition.

21. Process for the preparation of detergent compositions according to claim 20 wherein the amount of water which is added subsequently to the salification reaction and before the carbonation reaction, expressed in percentage by weight with respect to the total weight of the mixture subjected to carbonation, is comprised between 0.1% and 4%.

22. Process for the preparation of detergent compositions according to claim 21, wherein during the process, regardless of the order, a reaction solvent or a mixture thereof is added.

23. Process for the preparation of detergent compositions according to claim 22 wherein during the process, regardless of the order, a lubricant base oil is added, selected from the group consisting of mineral oil, synthetic oil, vegetable oil, animal oil, and mixtures thereof.

24. Process for the preparation of detergent compositions according to claim 23, wherein during the process, regardless of the order, one or more organic acids is added.

25. Process for the preparation of detergent compositions according to claim 24, wherein said one or more organic acids is selected from carboxylic, dicarboxylic and polycarboxylic acids having a number of carbon atoms from 6 to 100.

26. Process for the preparation of detergent compositions according to claim 25, wherein said organic acid is selected from a sulfonic acid of formula (R5)q-G-SO3H (V) wherein:

R5 is a linear or branched alkyl group containing from 6 to 40 carbon atoms or R5 is an alkyl substituent derived from a polymer of a C2-C6 olefin;

G is a C6-C20 aromatic hydrocarbon, an aliphatic hydrocarbon containing from 5 to 20 carbon atoms;

q is zero or an integer comprised between 1 and 5.

27. Process for the preparation of detergent compositions according to claim 25, wherein said organic acid is selected from salicylic acids substituted with linear or branched alkyl groups, in a number comprised between 1 and 3, each containing a number of carbon atoms comprised between 2 and 40.

28. Process for the preparation of detergent compositions according to claim 22 wherein the reaction solvent is selected from:

an alcohol with an acyclic or cyclic alkyl chain, or an alkyl aryl chain, containing a number of carbon atoms comprised between 1 and 16;

a poly-hydroxylated aliphatic hydrocarbon having a number of carbon atoms comprised between 2 and 4;

a di-alkylene glycol or a tri-alkylene glycol in which the alkylene group contains from 2 to 4 carbon atoms;

a mono-alkylene glycol alkyl ether, or a poly-alkylene glycol alkyl ether of formula:

(VII)

$$R_8O—(R_9O)_r—R_{10}$$

wherein R8 is an alkyl group containing a number of carbon atoms comprised between 1 and 6; R9 is a bivalent group containing carbon and hydrogen with a number of carbon atoms comprised between 2 and 4; R10 is hydrogen or an alkyl group with a number of carbon atoms comprised between 1 and 6; r is an integer comprised between 1 and 6;

a ketone with alkyl or alkyl-aryl groups, or aromatic groups, each containing a number of carbon atoms comprised between 1 and 10;

an ester of an aliphatic or aromatic carboxylic acid with a number of carbon atoms comprised between 1 and 10; and an aromatic or aliphatic hydrocarbon with a number of carbon atoms comprised between 5 and 16.

29. Process for the preparation of detergent compositions according to claim 20 which further comprises a step of maturation of the mixture obtained, after the carbonation reaction with carbon dioxide, in which the mixture can be kept stirred for a certain time interval at a certain temperature.

30. Process for the preparation of detergent compositions according to claim 20 which further comprises a step of removing the solvent and purifying the detergent composition.

31. Process for the preparation of detergent compositions according to claim 20 wherein the temperature during the salification reaction is between 30° C. and 200° C.

32. Process for the preparation of detergent compositions according to claim 20, wherein the carbonation reaction with carbon dioxide is carried out at a temperature comprised between 15° C. and 180° C.

33. Process for the preparation of detergent compositions according to claim 20, in which the carbonation reaction with carbon dioxide is carried out at an absolute pressure comprised between 1 bar and 5 bar.

34. Process for the preparation of detergent compositions according to claim 29, wherein the maturation step is carried out at a temperature comprised between 40° C. and 160° C.

35. Process for the preparation of detergent compositions according to claim 20 wherein the metal base is a basic compound of an alkaline earth metal, or of an alkali metal.

36. Lubricating compositions containing detergent compositions according to claim 19, a base oil or a mixture of base oils.

37. Method for lubricating engines of motor vehicles, comprising incorporating into the engines the lubricating compositions according to claim 36.

38. Method according to claim 37, wherein the engines are marine diesel engines.

39. Method for lubricating gears in industrial applications, comprising applying to the gears the lubricating compositions according to claim 36.

* * * * *